US012693083B2

(12) United States Patent
Saunders, Jr. et al.

(10) Patent No.: US 12,693,083 B2
(45) Date of Patent: Jul. 28, 2026

(54) BOLT ASSEMBLY FOR FIREARM

(71) Applicant: Sturm, Ruger & Company, Inc., Southport, CT (US)

(72) Inventors: Frank J. Saunders, Jr., Dunbarton, NH (US); Reed Matthew Hubbell, Prescott, AZ (US); Benjamin Gerard Hawkins, Sunapee, NH (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 19/213,129

(22) Filed: May 20, 2025

(65) Prior Publication Data

US 2025/0283679 A1 Sep. 11, 2025

Related U.S. Application Data

(63) Continuation of application No. 18/238,235, filed on Aug. 25, 2023, now Pat. No. 12,320,608.

(60) Provisional application No. 63/498,124, filed on Apr. 25, 2023, provisional application No. 63/400,939, filed on Aug. 25, 2022.

(51) Int. Cl.

| | |
|---|---|
| ***F41A 3/12*** | (2006.01) |
| ***F41A 3/66*** | (2006.01) |
| ***F41A 3/80*** | (2006.01) |

(52) U.S. Cl.

CPC ..... *F41A 3/80* (2013.01); *F41A 3/12* (2013.01); *F41A 3/66* (2013.01)

(58) Field of Classification Search

USPC ..... 89/194–197

See application file for complete search history.

(56) References Cited

U.S. PATENT DOCUMENTS

| | | | |
|---|---|---|---|
| 2,971,441 | A | 2/1961 | Reed |
| 3,283,435 | A | 11/1966 | Koch |
| 3,651,736 | A | 3/1972 | Ingram et al. |
| 3,990,346 | A | 11/1976 | Irwin |
| 4,066,000 | A | 1/1978 | Rostocil |
| 4,335,643 | A | 6/1982 | Gal |
| 4,358,986 | A | 11/1982 | Giorgio |
| 4,440,062 | A | 4/1984 | McQueen |
| 4,569,270 | A | 2/1986 | Timari |
| 5,920,028 | A | 7/1999 | Guhring et al. |
| 6,931,978 | B1 | 8/2005 | Dionne |
| 8,806,789 | B2 | 8/2014 | Devine |
| 9,857,136 | B2 | 1/2018 | Hayes et al. |
| 10,107,577 | B2 | 10/2018 | Kuhnle et al. |
| 10,184,739 | B2 | 1/2019 | Gangl |
| 10,545,005 | B2 | 1/2020 | Bender |

(Continued)

*Primary Examiner* — Reginald S Tillman, Jr.

(74) *Attorney, Agent, or Firm* — The Belles Group, P.C.

(57) ABSTRACT

A modular two-piece bolt system for firearms with blowback actions provides a rear bolt piece which detachably couples to plural different front bolt pieces each of different mass. The front bolt pieces have a similar configuration and common coupling interface which forms an interlocked relationship with a complementary configured coupling interface on the rear bolt piece to prevent axial separation of the pieces when the action of the firearm is cycled. The system allows various front bolt pieces to be selected and used interchangeably with the rear bolt piece so that a front bolt piece of proper mass can be matched to the energy of ammunition to be fired. The front and rear bolt pieces when coupled define a continuous extended longitudinal passage which receives the rear breech end portion of the firearm barrel therethrough to reduce the projected length of the barrel.

20 Claims, 35 Drawing Sheets

(56) References Cited

U.S. PATENT DOCUMENTS

| | | | |
|---|---|---|---|
| 10,746,493 | B1 | 8/2020 | Steimke et al. |
| 10,782,082 | B2 | 9/2020 | Wilkinson et al. |
| 10,816,287 | B1 | 10/2020 | Russo et al. |
| 10,969,183 | B2 | 4/2021 | Gibbens et al. |
| 11,143,488 | B2 | 10/2021 | Dewalch |
| 11,215,412 | B2 | 1/2022 | Spangler et al. |
| 11,371,789 | B2 | 6/2022 | Underwood et al. |
| 2009/0151213 | A1 | 6/2009 | Bell |
| 2014/0224112 | A1 | 8/2014 | Verry |
| 2016/0265859 | A1 | 9/2016 | Chaber, Jr. |
| 2016/0370135 | A1 | 12/2016 | Plumb et al. |
| 2017/0115078 | A1 | 4/2017 | Plumb |
| 2017/0227314 | A1 | 8/2017 | Owens et al. |
| 2019/0120579 | A1 | 4/2019 | Wilkinson et al. |

BOLT ASSEMBLY FOR FIREARM

CROSS-REFERENCE TO RELATED APPLICATIONS

The present application is a continuation of U.S. patent application Ser. No. 18/238,235 filed Aug. 25, 2023, which claims the benefit of priority to U.S. Provisional Patent Application No. 63/498,124 filed Apr. 25, 2023, and U.S. Provisional Patent Application No. 63/400,939 filed Aug. 25, 2022; the entireties of the foregoing applications are all incorporated herein by reference.

BACKGROUND

The present invention generally relates to firearms, and more particularly to bolts for blowback operated firearms such as long guns including rifles, carbines, and shotguns.

The mass of bolts used in auto-loading firearms having a blowback type operating system to cycle the action between open and closed breech positions must be precisely selected. In blowback actions, the mass of the slideable bolt carried by the receiver and the recoil spring maintains a closed breech until the firearm is fired. Accordingly, the masses of such bolts must be matched to the propellant powder charge or load of the particular cartridge to be fired in the firearm. Therefore, multiple bolts with different masses must be fabricated by the firearm manufacturer. In addition, if a user decides to change the caliber of their firearm, a complete bolt must be purchased which can be costly.

Improvement in bolts for firearms with blowback type operating systems is desired which have some degree of modularity to provide bolt fabrication and replacement flexibility and economies to accommodate firing different ammunition with different powder charges or loads in the firearm.

SUMMARY OF THE INVENTION

According to one embodiment, a modular two-piece bolt for a blowback action may be provided forming a bolt assembly including a front bolt piece detachably coupled to a rear bolt piece. The rear bolt piece defines the breech face which is movable into and out of battery (i.e. engagement) with the rear breech end of the barrel via cycling the bolt assembly. Advantageously, the interchangeable front bolt piece may have a mass selected to provide the necessary total mass of the bolt assembly (front and rear bolt pieces) to match the propellant powder load or charge of the ammunition cartridge for which the firearm is chambered. This advantageously provides bolt fabrication and user replacement economies.

A modular bolt system according to the present disclosure comprises a plurality of front bolt pieces of similar configuration but each having a different mass. The front bolt pieces all share a common coupling interface configured for detachable coupling to the mating coupling feature of the rear bolt piece. The coupling feature of the rear bolt piece therefore has a configuration compatible for use with the plurality of front bolt pieces via the common coupling interface. This allows a standardized design of a rear bolt piece to be fabricated by the firearm manufacturer which is interchangeable with the different front bolt pieces of varying mass.

Certain calibers of cartridges may be commercially offered in a variety of different propellant powder charges or loads. In such cases, the same rear bolt piece may be used which comprises the breech face that is compatible for use with all of the cartridges of the same caliber but with different charges in each. An appropriate front bolt piece may be selected and coupled to the rear bolt piece which gives the entire bolt assembly the total mass required for the powder charge of the cartridge to be fired. In this situation, the rear bolt piece therefore does not need to be replaced when selecting the appropriate front bolt piece.

The firearm in one embodiment may comprise a bolt-over-barrel design in one embodiment. Each of the front and rear bolt pieces defines a portion of an extended longitudinal passage which receives a length of the rear breech end portion of the firearm barrel. The rear breech end portion of the barrel therefore extends a substantial distance into the axial cavity of the receiver which slideably receives the bolt assembly, as further described herein. This advantageously shortens the forward projected length of the barrel which is therefore amendable for use in a carbine firearm in contrast to a standard rifle having a longer barrel projected length. The two piece bolt assembly allows for assembly and disassembly of the firearm while having the rear of the receiver immovable. Otherwise, the length of the bolt assembly would be greater than the opening it is allowed to be inserted into.

In one aspect, a firearm with bolt assembly for a blowback operating system comprises: a longitudinal axis; a receiver defining an axially elongated internal cavity; a barrel supported by the receiver, the barrel defining an axial bore extending longitudinally from a rear breech end to a front muzzle end of the barrel; a bolt assembly slideably disposed in the cavity of the receiver, the bolt assembly axially movable between a forward closed breech position in battery with the rear breech end of the barrel and a rearward open breech position; a recoil spring biasing the bolt forward towards the closed breech position; the bolt assembly comprising a front bolt piece detachably coupled to a rear bolt piece; the front and rear bolt pieces each comprising a longitudinal passage coaxial with the longitudinal axis of the firearm, the longitudinal passage of the front bolt piece in communication with the longitudinal passage of the rear bolt piece to collectively form a continuous extended longitudinal passage; wherein a rear breech end of the barrel is disposed inside the extended longitudinal passage. The front and rear bolt pieces are keyed into one another by a coupling protrusion disposed on the front or rear bolt piece interlocked with a mating coupling recess disposed on the other of the front or rear bolt piece.

According to another aspect, a bolt assembly for a firearm with blowback operating system comprises: a longitudinal axis; an axially elongated front bolt piece internally comprising a first longitudinal passage coaxial with the longitudinal axis, the first longitudinal passage being configured to receive a barrel of the firearm; an axially elongated rear bolt piece internally comprising a second longitudinal passage coaxial with the longitudinal axis, the second longitudinal passage being configured to receive the barrel of the firearm; the second longitudinal passage being in communication with the first longitudinal passage of the front bolt piece to collectively form a continuous extended longitudinal passage; the front bolt piece being detachably coupled to the rear bolt piece and interlocked together to prevent separation in a longitudinal direction; and a breech face formed in the second longitudinal passage of the rear bolt piece.

According to another aspect, a modular bolt assembly system for a firearm with blowback operating system comprises: a longitudinal axis; a first front bolt piece having a first mass and internally comprising a first longitudinal passage coaxial with the longitudinal axis, the first longitudinal passage being configured to receive a rear portion of a first firearm barrel chambered for a first cartridge; a second front bolt piece having a second mass different than the first mass, the second front bolt piece internally comprising a second longitudinal passage coaxial with the longitudinal axis, the second longitudinal passage being configured to receive a rear portion of a second firearm barrel chambered for a second cartridge having a propellant powder charge with energy different than the first cartridge; a rear bolt piece internally comprising a third longitudinal passage coaxial with the longitudinal axis, the third longitudinal passage comprising a breech face and being configured to receive the rear portions of the first or second firearm barrel; wherein the first and second front bolt pieces each have a common first coupling interface configured to mate with a corresponding complementary configured second coupling interface formed on the rear bolt piece; wherein the rear bolt piece is detachably coupleable to the first or second front bolt piece to form a mechanical interlock which prevents separation thereof in a direction along the longitudinal axis.

According to another aspect, a method for matching a bolt assembly to a firearm comprises: providing a firearm comprising a longitudinal axis and a receiver defining an axially extending cavity; providing a barrel chambered for a first cartridge having a first propellant powder charge; providing a rear bolt piece comprising a longitudinal passage and a breech face formed in the longitudinal passage; selecting a front bolt piece from a plurality of front bolt pieces each having a different mass and a longitudinal passage, the selected front bolt piece having a mass compatible for use with firing the first cartridge in the firearm; coupling the first front bolt piece to the rear bolt piece to form a bolt assembly; and inserting the bolt assembly into the cavity of the receiver.

Embodiments of the present invention may also provide an ambidextrous bolt release mechanism for a firearm, which is usable with the foregoing two-piece bolt. The bolt-catch release mechanism comprises a bolt catch including an axially elongated bolt catch lever pivotably mounted on one side of the firearm, and a spring-biased actuator plunger accessible from the opposite side of the firearm which cooperates with the lever to form an ambidextrous mechanism. The bolt catch lever is configured and operable to engage and lock the axially movable bolt of the firearm action in a rearward open breech position when the lever is engaged with the bolt. The manually operated plunger is transversely oriented to the bolt catch lever and slideably engageable with the lever to cause rotation thereof for disengaging and releasing the bolt from the rearward open breech position. Alternatively, the bolt catch lever may also be manually actuated directly by the user to release the bolt.

In one unique aspect of the present invention, the bolt catch lever in one embodiment includes an inclined camming ramp which forms an operating surface that is in turn acted upon by a complementary angled inclined camming surface defined by a working end of the actuator plunger opposite the operating end which a user depresses inward to actuate the plunger. A flat-to-flat sliding interface is formed in one embodiment between the inclined camming surface and ramp. The camming surface may be defined by a conical tip of the plunger in one implementation.

When the bolt is held and locked in rearward in its open breech position via the bolt catch lever, the inclined camming surface of the actuator plunger acts as a wedge that pries and rotates the bolt catch lever out of engagement with the bolt when the user-accessible operating end of the plunger is pressed inwards to slide the plunger towards the lever. This releases the bolt forward to reclose the breech.

The actuator plunger advantageously permits the user to release the bolt from both sides of the firearm; either by manually moving the integrated bolt catch lever directly on one side of the firearm, or via manually actuating the spring-loaded plunger from the other side. The spring-loaded plunger may be located on the firearm in a position selected for easy actuation by the user's index finger in one embodiment. This allows an ergonomic and natural motion for the user to increase the speed and ease of reloading the firearm, which is particularly beneficial for purposes such as competition shooting. Additionally, the spring-biased plunger is useful for shooters with an opposite dominant hand, which could cause difficulty in accessing the traditional integrated bolt catch lever on one side. These shooters may instead press the plunger inwards for actuation with their non-dominant hand after using this hand to insert the ammunition magazine, thereby permitting a speedy and easy reloading process.

The plunger may be spring-biased in a direction away from the bolt catch lever to the degree that avoids actuation of the lever until the plunger is manually actuated by the user. As a result, the plunger does not hinder mechanical function or movement of the bolt catch with unnecessary added inertial load, friction, or other encumbrances.

The firearm may comprise a blowback action in which the mass of the slideable bolt carried by the receiver and the recoil spring maintains a closed breech until the firearm is fired (or bolt is manually retracted). The blowback action bolt is not rotatable or configured to form a locked breech since the bolt does not contain radial bolt lugs which lock up with corresponding barrel locking lugs in the rear breech end of the barrel to lock the breech as in some firearms; this latter arrangement being typically used with cylindrical bolts that are rotatable between locked and unlocked position. The bolt body of the present bolt design may have a substantially rectangular cuboid configuration in some embodiments.

BRIEF DESCRIPTION OF THE DRAWINGS

The features of the exemplary embodiments will be described with reference to the following drawings where like elements are labeled similarly, and in which.

Figure 1:
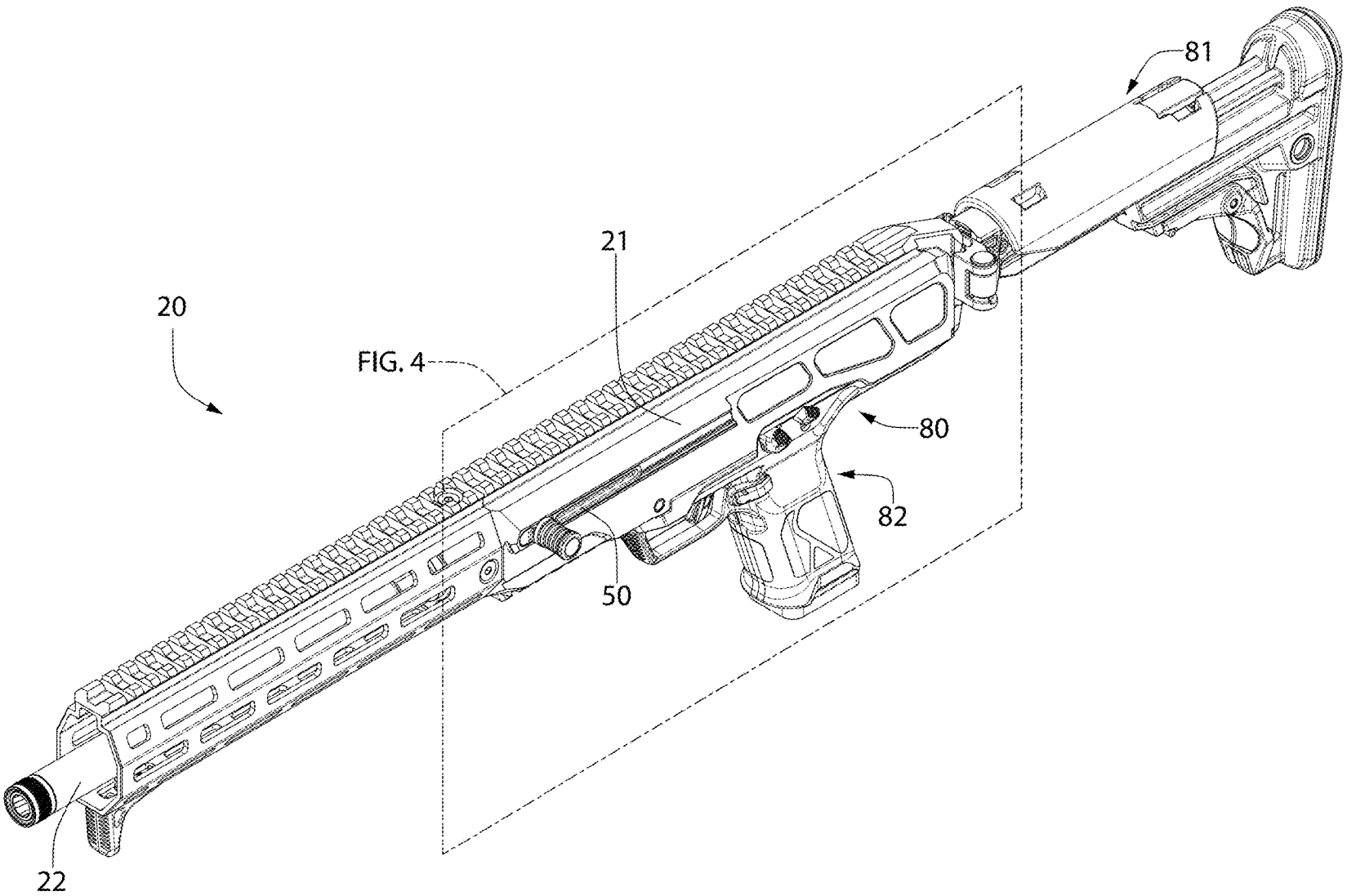
FIG. 1 is a top perspective view of a firearm with bolt catch and bolt assembly according to the present disclosure.
Figure 2:
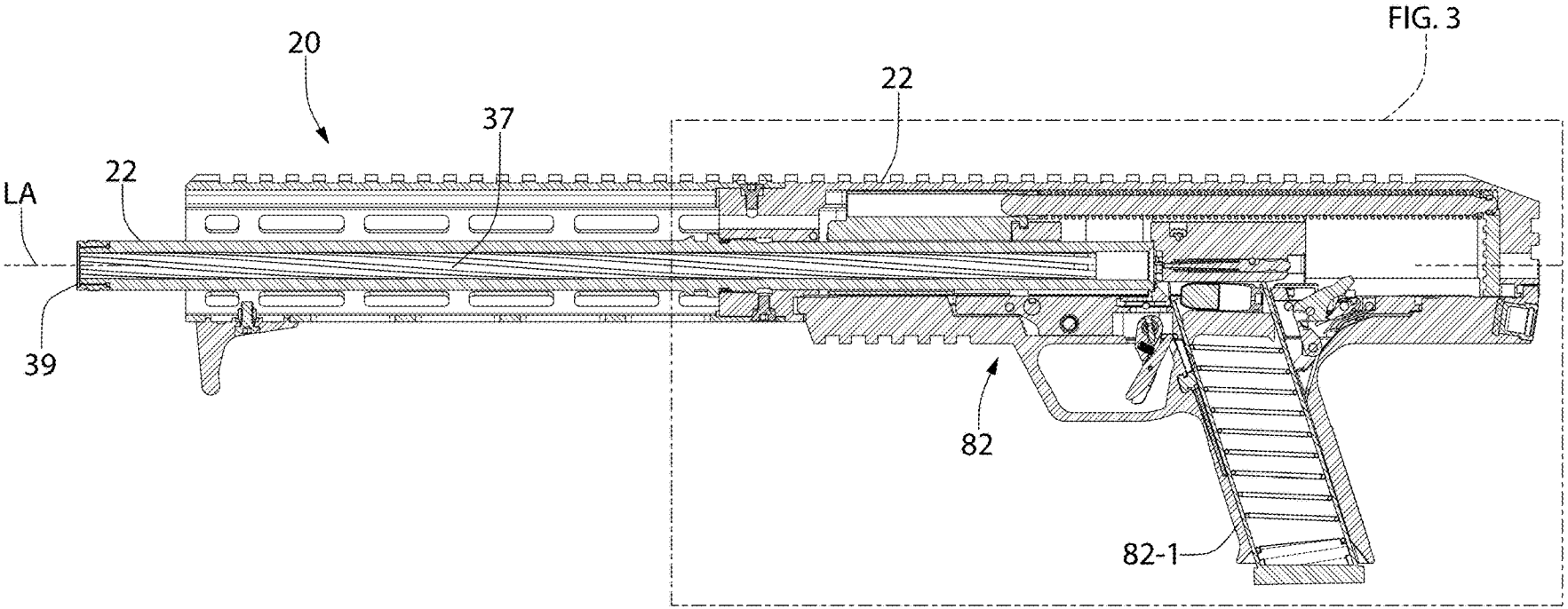
FIG. 2 is a left side cross sectional view thereof.

All drawings are schematic and not necessarily to scale. Parts shown and/or given a reference numerical designation in one figure may be considered to be the same parts where they appear in other figures without a numerical designation for brevity unless specifically labeled with a different part number and described herein. A reference herein to a figure by a whole number which includes multiple figures sharing the same whole number but with different alphabetical suffixes shall be construed as a general reference to all of those figures unless expressly noted otherwise.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-33 generally depict a magazine-fed autoloading semi-automatic firearm 20 including a bolt release mechanism and various aspects thereof according to the present disclosure. In one non-limiting embodiment, the firearm may be a long gun such as a rifle, carbine, or shotgun. The non-limiting illustrated embodiment, selected for convenience of description only as one representative firearm, shows a carbine which is essentially a rifle with space-efficient barrel projection useful for many purposes such as competitive action shooting. In other embodiments, however, the bolt release mechanism disclosed herein may be applied to pistols to lock the axially movable slide in a rearward open breech position. Accordingly, the bolt catch is not limited in its applicability to any particular firearm format alone in which it is desirable to lock the bolt or slide in a rearward open breech position either manually or automatically via operation of the magazine follower, and to release the bolt forward to reclose the breech.

Firearm 20 includes a longitudinal axis LA, receiver 21, barrel 22 coupled thereto, bolt 50, and a trigger-actuated firing mechanism 23 which may be supported directly by the receiver or alternatively a detachable fire control insert 23-1 as illustrated herein. Firing mechanism 23 includes movable trigger 24 for actuating the mechanism to discharge the firearm. The firearm includes a chassis or stock 80 including buttstock 81 for shouldering the firearm and mid-stock 82 to which the receiver 21 is detachbly coupled by any suitable method used in the art such as via mounting pins, threaded fasteners, interlocking surfaces or protrusions, combinations thereof, or other mechanical fastening means. In one embodiment, the mid-stock may be a downwardly extending pistol grip frame 82-1 which defines a magazine well 32. In this case, receiver 21 may be detachably mounted to the pistol grip frame 82-1. Pistol grip frame 82-1 may include a open loop-shaped bottom trigger guard 24-1 which surrounds and helps protect the trigger 24 against unintentional actuation.

Downwardly and upwardly open magazine well 32 detachably holds ammunition magazine 33 comprising an internal magazine cavity 33-4 containing a plurality of cartridges (rounds) mounted therein. Such magazines may have a straight or curved box-type in some embodiments which contains a spring-biased stack of ammunition cartridges which are uploaded into the breech area 34 by a spring feed mechanism for chambering into the rearwardly open chamber 36 of barrel 22 by the bolt 50 in a conventional manner when cycling the action (example of box-type magazine illustrated in the figures). The spring feed mechanism disposed in magazine cavity 33-4 includes a follower 33-1 which supports a vertical stack of cartridges C and magazine spring 33-2 which acts on the follower to bias the cartridges upwards towards the open top of the magazine for feeding into the breech area of the receiver in a conventional manner (see, e.g., FIG. 3). Spring 33-2 acts between magazine floor plate 33-3 coupled to the bottom of the magazine tube and the bottom of follower 33-1 at top. The follower is operably interfaced with the bolt catch 100 to automatically actuate the catch to lock the bolt rearward as a last round hold open feature, further described herein. Any type of cartridges may be used depending on the type of cartridge for which the firearm is chambered, including centerfire or rimfire cartridges both of which are well known in the art without further undue elaboration.

The magazine 33 is removably retained in the magazine well 32 by a movable magazine latch 35. Latch 35 may be slideably mounted to pistol grip frame 82-1 of the mid-stock 82 in one embodiment and is configured to alternatingly lock the magazine in the firearm or release the magazine when the latch is manually actuated by the user. Latch 35 may be mounted in the front of pistol grip frame 82-1 proximate to the front of the magazine well 32 in one embodiment as shown for front latching type magazines. However, latch 35 may alternatively be mounted on either side of the pistol grip frame 82-1 or at the rear thereof if other latching type magazines are used. The location of the latch does not limit the present invention in any manner.

Barrel 22 includes an axial bore 37 extending longitudinally and axially from a rear breech end 38 to a front muzzle end 39 of the barrel. The bore 37, which may be rifled, defines a projectile passageway through which a bullet or slug is discharged from the firearm. The centerline of bore 37 is coaxial with and defines the longitudinal axis LA of the firearm. The rear breech end 38 of the barrel 22 defines a rearwardly open diametrically enlarged chamber 36 configured for holding a cartridge. Chamber 36 communicates with barrel bore 37.

Figure 3:
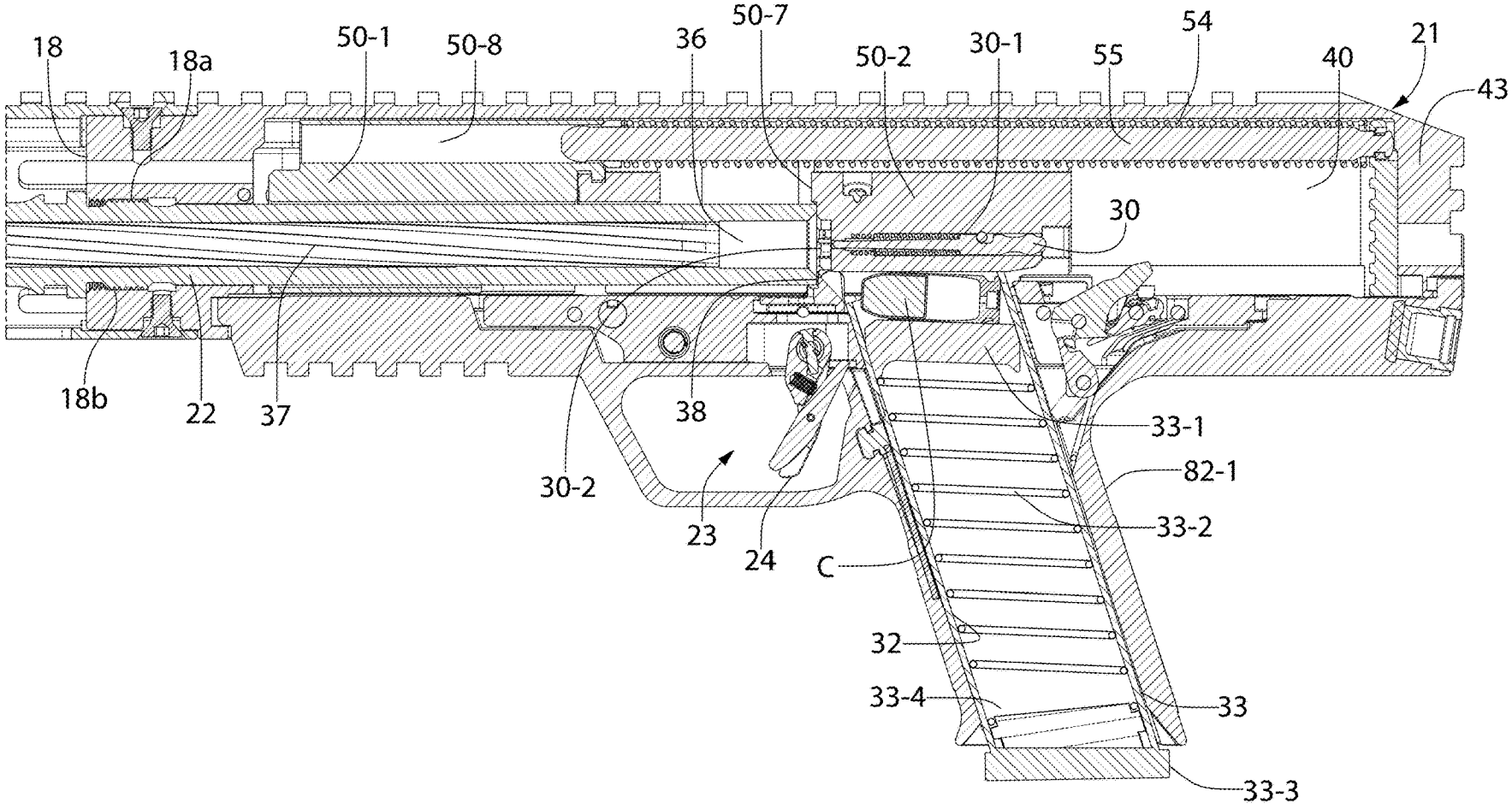
FIG. 3 is an enlarged detail taken from FIG. 2.
Figure 4:
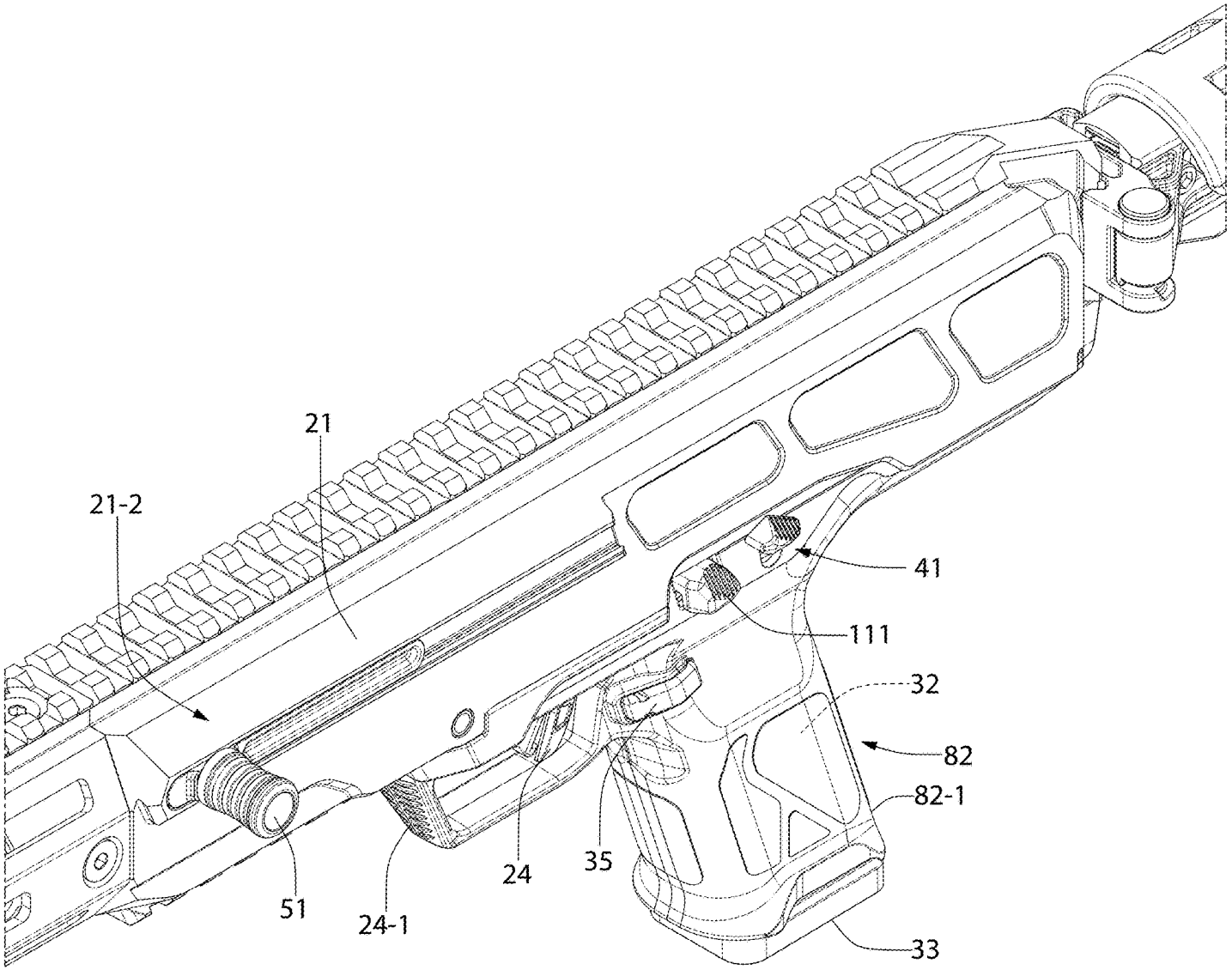
FIG. 4 is an enlarged detail taken from FIG. 1.
Figure 5:
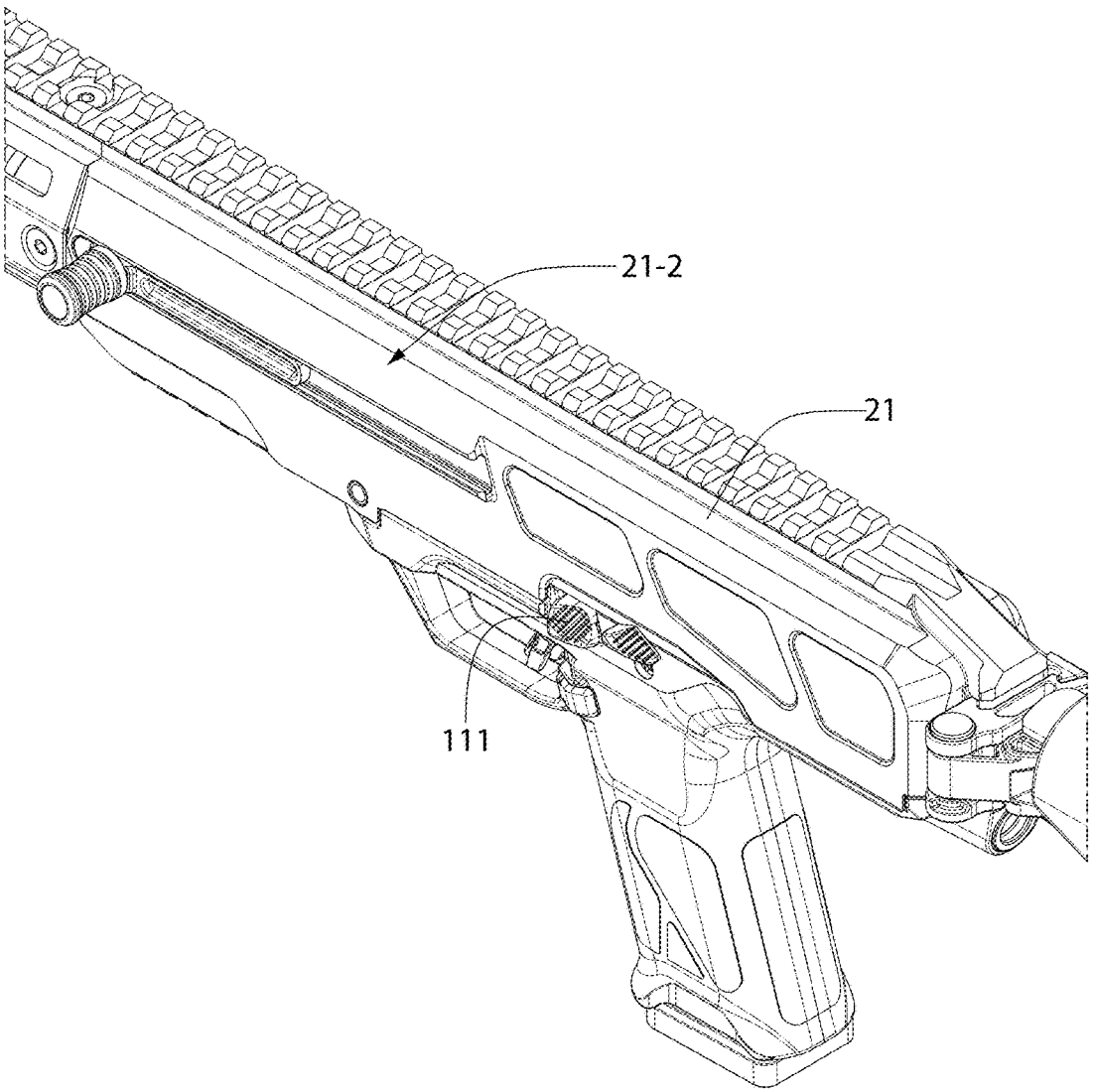
FIG. 5 is a left side rear perspective view of the mid-stock are of the firearm.
Figure 6:
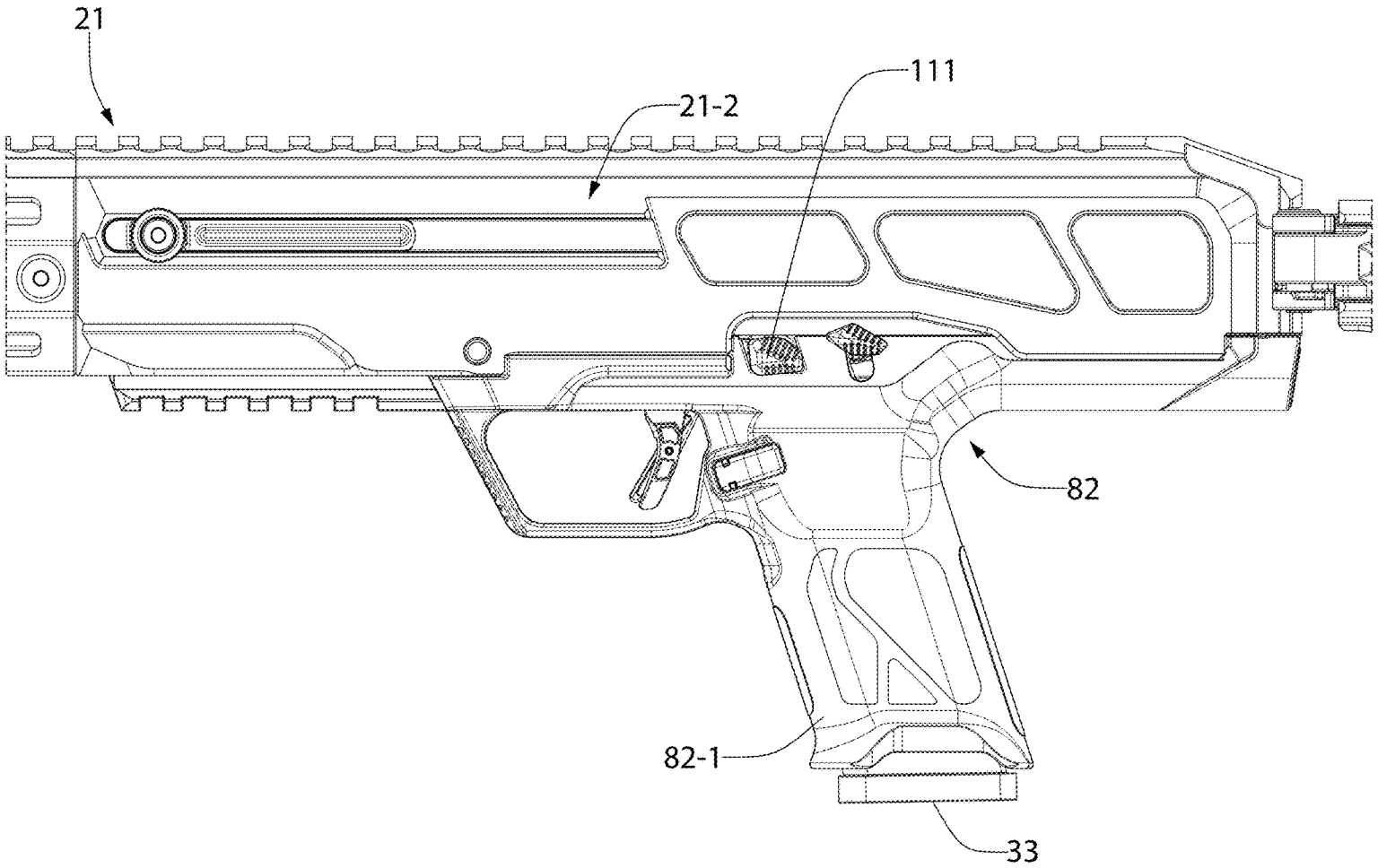
FIG. 6 is a left side view thereof.
Figure 7:
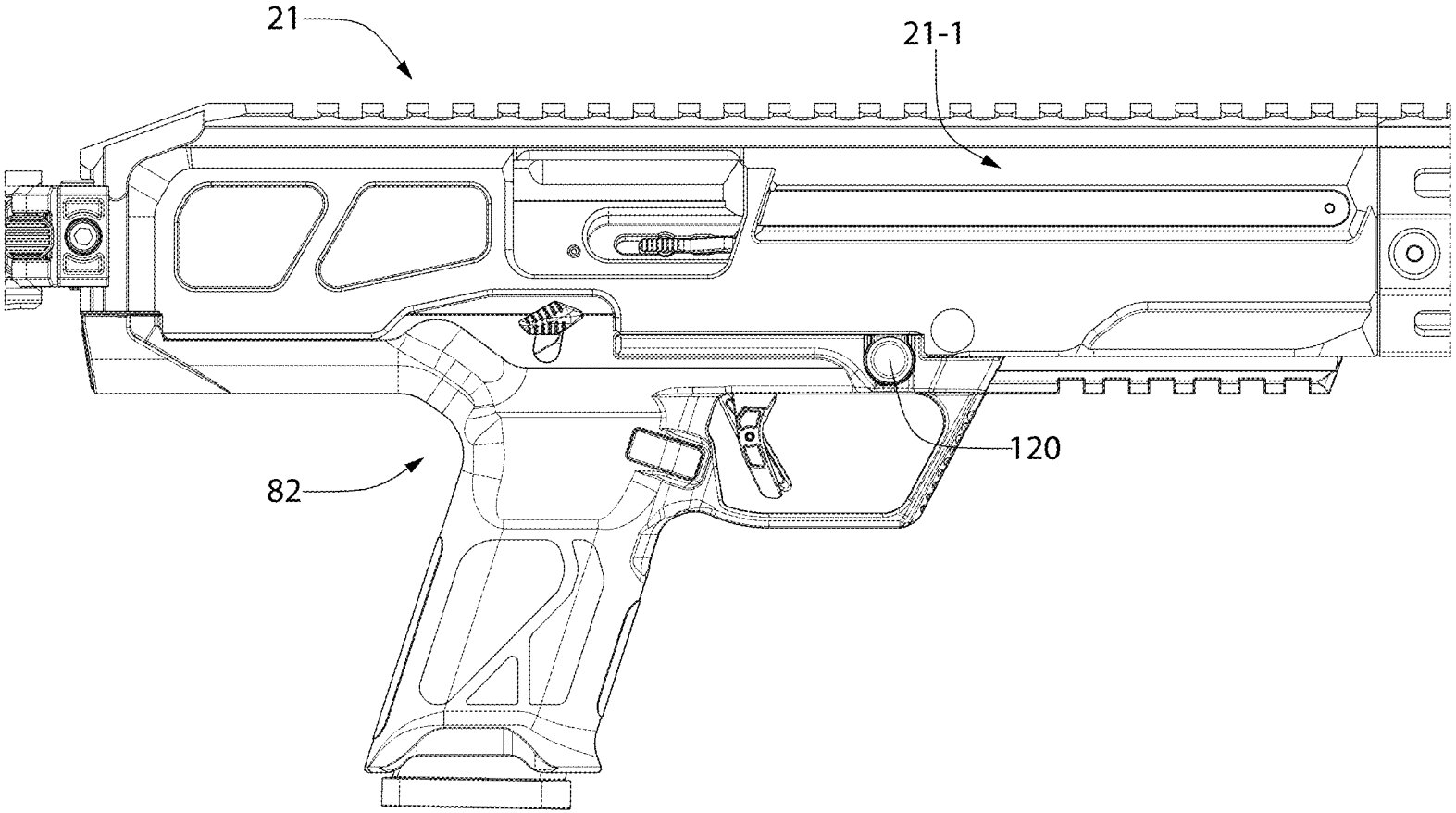
FIG. 7 is a right side view thereof.

Receiver 21 defines an axially elongated internal cavity 40 which slideably carries and supports the bolt 50 (see, e.g., FIG. 3). Cavity 40 may be upwardly open for inserting the bolt therein over the rear portion of barrel 22 which may project into the cavity by greater than 25% of the length of the cavity as shown. Barrel may extend 50% or more into the length of cavity 40 in some embodiments, and may occupy a majority of the length of the cavity in one embodiment as shown.

Cavity 40 of receiver 21 extends along the longitudinal axis LA between the receiver open front end 18 in communication with the barrel chamber 36 for loading cartridges therein and a closed rear end 19 defined by vertical rear end wall 43. The cavity has a sufficient length to permit the bolt 50 to cycle rearward far enough to extract and eject a cartridge from magazine 33, and load a fresh cartridge therefrom into the barrel. Barrel 22 is coupled to the front end 18 of the receiver via any suitable method used in the art. In one embodiment, a threaded coupling may be used in which barrel 22 includes threads 18*a* which rotatably engage a threaded socket 18*b* formed on the receiver front end. The threaded portion of the barrel is spaced forward from its rear breech end 38 by a distance (see, e.g., FIG. 3). Accordingly, the rear breech end of the barrel is not threaded. The receiver 221 is detachably coupled to and supported by the frame 82 by any suitable means including pins and/or fasteners, interlocking tabs, etc.

For convenience of assembly and maintenance/repair, the firing mechanism 23 in one embodiment as shown may be housed and mounted in a separate fire control insert 23-1 (see, e.g., FIGS. 12 and 14-23). Fire control insert 23-1 is detachably and removably mounted to the lower portion of the mid-stock 82 such as to the pistol grip frame 82-1 in the illustrated embodiment via any suitable method used in the art such as for example without limitation via mounting pins, threaded fasteners, interlocking surfaces or protrusions, combinations thereof, or other mechanical fastening means. Other suitable type fastening means however may be used. Grip frame 82-1 defines an upwardly open longitudinal receptacle 82-2 which receives the fire control insert and certain components of the fire control system therein (see, e.g., FIG. 12). The fire control insert 23-1 includes an internal cavity 23-2 for mounting various fire control components further described herein.

In one embodiment, firearm 20 may include a rotatable manual safety mechanism 41 is transversely movably mounted in fire control insert 23-1 and configured to interact with a component of the firing mechanism for rendering the firing mechanism in either a disabled (safe) or enabled (fire) condition. Safety 41 may be an ambidextrous safety operably from either lateral side of the firearm. Such a safety may include right safety operating button 41-2 operably coupled to a left safety operating button 41-1 via a transversely mounted shaft 41-3 extending from side-to-side through the fire control insert.

Fire control insert 23-1 may be formed of any suitable metallic and/or reinforced polymeric material in some embodiments. The fire control insert has an axially elongated body defining a front end 70, rear end 71, right lateral side 72, and left lateral side 73. The fire control insert body extends along the longitudinal axis LA and may include features to key the insert into the pistol grip frame 82-1 for proper alignment therewith to couple these components together as described elsewhere herein.

In addition to trigger 24, the firing mechanism 23 may include the following additional components mounted to the fire control insert 23-1: a pivotable and cockable spring-biased hammer 25; spring-biased pivotable sear 26 which is configured and operable to hold the hammer in a rear cocked position, and trigger bar 27 operably coupled between and to the trigger and sear for actuating the sear via a trigger pull to release the hammer from the cocked position for firing the firearm. Trigger pivot 24-1 mounts trigger 24 to the fire control insert in a pivotable manner in one embodiment. Trigger spring 24-1 may be a torsion spring with a coil portion mounted about the trigger pin to bias the trigger 24 forward to a ready-to-fire position, and a rearward extending leg which acts on the trigger bar 27 to bias it upwards for engagement of a sear operating protrusion 27-1 at the rear end of the trigger bar with the sear.

Hammer 25 is biased forward towards a front firing position by hammer spring 31. Sear 26 is biased towards engagement with the hammer via sear spring 26-1. Pulling the trigger 24 rearward shifts the trigger bar 27 forward which in turn rotates the sear 26 via sear operating protrusion 27-1 on the trigger bar. This disengages a hook or ledge 28 formed on the front of the sear from sear notch 29 on the hammer 25, thereby releasing spring-biased hammer 25 forward which strikes the rear end of firing pin 30 slidably carried by the bolt 50. This drives the firing pin forward to strike a chambered cartridge held in the chamber 36 of the barrel 22 for discharging the firearm 20.

Referring generally to FIGS. 3 and 8-13, bolt 50 in one embodiment may comprise an axially elongated block-shape metal body of substantially rectilinear (e.g. rectangular cuboid) shape. The term "substantially" connotes that the overall bolt body configuration may be considered to approximate a rectangular cuboid in contrast to cylindrical firearm bolts, and excludes protruding or recessed features appended on the bolt body. Bolt 50 may have a monolithic unitary one-piece structure, or alternatively may be a two-piece construction as illustrated herein comprising a front bolt piece 50-1 and rear bolt piece 50-2 detachably coupled together to collectively form a bolt assembly. Each bolt piece may have a monolithic unitary structure in which features disclosed herein (including the keyed mutually configured male and female coupling features) are formed by any suitable mechanical fabrication means used in the art such as casting, metal injection molding, milling, boring, drilling, machining, etc. and combinations thereof. This is distinguishable from rotating bolt designs of some auto-loading rifles such as gas-operated ARs which may comprise a non-rotatable bolt carrier and a separate discrete rotatable bolt comprising the radial bolt lugs for forming a locked breech. These type bolts are not used or compatible with firearms having a blowback operating system such as disclosed herein which do not form locked breeches that no parts of the bolt are rotatable as in the present two-piece keyed bolt design.

It bears noting that reference to "bolt 50" herein should also be considered and construed to also include reference to the entire two-piece bolt assembly as applicable; the singular term "bolt" being interchangeably used for brevity of description.

Significantly, the two-piece bolt construction advantageously provides a modular bolt system which allows the mass of the bolt assembly to be altered via swapping out only one the bolt pieces with another having a greater or less mass, which affects the recoil of the bolt mass rearward when the firearm is fired based on the loading type (powder charge) for a given caliber. The bolt therefore is customizable to ensure proper cycling of the action (i.e. fully open and reclose breech).

In one embodiment, the front bolt piece 50-1 of the bolt assembly 50 may be the piece whose mass can be varied. Accordingly, a plurality of front bolt pieces 50-1 each with similar bolt body configuration and a common coupling feature or interface but different masses may be provided which are all configured to be compatible for interchangeable use and coupling with a single rear bolt piece 50-2 having a coupling feature to which the front bolt pieces can be detachably coupled. This advantageously provides fabrication and replacement economies for the firearm manufacturer and end user thereby allowing a single firearm to accommodate a range of propellant powder charges/loads for a particular caliber of ammunition simply by swapping front bolt pieces.

Various interchangeable front bolt pieces 50-1 for bolt 50 therefore allows for configuring a given caliber within the allowable range of ammunition load offerings on the market. This also significantly simplifies the amount of alterations to the bolt system. Barrels and various other features may also need changing. It further bears noting that the rear bolt piece defines the breech face which is still often caliber specific. Accordingly, changing calibers of ammunition may require a different rear bolt piece to match the breech face to the caliber selected.

As further explanation of the foregoing concept, blowback operating systems of firearms cycle the action by first moving the bolt first rearward to open the breech after firing to extract and eject an ammunition cartridge from the barrel cartridge chamber. The recoil spring then automatically returns the bolt forward to strip a fresh cartridge out of the magazine and chamber the cartridge as the breech is reclosed and readied for the next shot.

The rearward acting recoil forces generated by firing the firearm must be sufficient to move the bolt rearward and properly time opening of the breech by taking into account the total mass of the bolt and contribution of the forward acting spring force of recoil spring 54 which is compressed when the breech is opened. The recoil spring biases the bolt forward towards the closed breech position in opposition to the recoil forces. Accordingly, it is crucial to match the mass of the bolt to the propellant powder charge or load of the caliber of cartridge for which the firearm is chambered to ensure proper cycling of the action. If the bolt mas is too low for the cartridge, the bolt may cycle rearward too quickly which can damage the bolt or return the bolt prematurely forward to reclose the breech before a new cartridge can be full uploaded from the magazine thereby jamming the action. Conversely, if the bolt mass is too great the bolt may not cycle rearward sufficiently to fully open the breech, or too slowly which adversely affects the timing of the action. It is therefore clear that the timing of the action affected by the bolt mass is critical to proper operation of the firearm.

Accordingly, if the manufacturer offers a same firearm configured to fire a particular caliber of ammunition but with different powder charges/loads to meet consumer needs and preferences, individual entire one-piece monolithic bolts would have to be manufactured in a variety of masses This becomes an expensive proposition for the firearm manufacturer or end user seeking to change ammunition calibers since the blowback bolts are machined parts.

The present invention provides a modular two-piece bolt system configured for blowback operation which advantageously allows the same rear bolt piece 50-2 which includes the breech face to be used for a certain caliber of ammunition but which may be offered commercially in variety of different propellant powder charges/loads. For example, 10 mm caliber cartridges have muzzle energy which drastically varies based on the particular ammunition powder charge/load selected; all within the 10 mm family. Another use case is the use of suppressors. These increase backpressure, transferring more energy to the bolt. A heavier front bolt with greater mass is desirable for use with a suppressor. Accordingly, even though the caliber and powder charge/load of the ammunition might not be changed, adding a suppressor changes the mass requirements for the front bolt and entire bolt assembly.

In both foregoing scenarios, only the front bolt piece 50-1 of the modular bolt assembly needs to be selected for use to adjust and match the collective total mass of the entire 2-piece bolt assembly to the energy (e.g., propellant powder load) generated by a particular powder charge/load of the cartridge to be fired with the firearm. In the present design, the mass of the rear bolt piece is therefore a fixed parameter. A plurality of different mass front bolt pieces may be manufactured from which the manufacturer can select and couple the appropriate one to the rear bolt piece which is compatible for firing with the powder charge/load of the particular cartridge desired. Furthermore, the rear bolt piece may be more expensive to fabricate of the two bolt pieces since the rear bolt piece 50-2 of the bolt assembly disclosed herein contains the breech face and flanged coupling protrusion. The modular two-piece bolt system therefore provides both fabrication/supply economies and manufacturing efficiencies.

The modular bolt system is designed so that in one application an end user who initially owns a firearm with a first barrel chambered for a first cartridge of a given caliber with a powder charge/load and corresponding mass-matched 2-piece bolt 50 disclosed herein may change the cartridge to be fired of the same caliber. Accordingly, a second barrel chambered for a second cartridge of the same given caliber but with a different propellant powder charge/load (e.g., less or greater than the first cartridge) may be retrofit and installed to replace the first barrel and the front piece 50-1 of the bolt assembly. The 2-piece bolt 50 may be removed from the firearm followed by uncoupling a first front bolt piece 50-1 having a first mass from the rear bolt piece 50-2. The first front bolt piece 50-1 is then exchanged for a second front bolt piece having a different second mass than the first front bolt piece; the second front bolt piece being compatible for firing the second cartridge.

Accordingly, using the foregoing retrofit method or process, the same firearm may be re-used and retrofitted to change the cartridge to be fired within the same thereby offering significant cost savings to the user compared to having to purchase an entire bolt or even second firearm to fire the second cartridge.

It bears noting that in physics and engineering terms "mass" is not identical to "weight." Mass is the amount of matter present in an object while its weight is a measure of the strength of the force with which gravity pulls on the object. The weight of an object (pound-force) is equal to the mass (slugs)×gravity (feet/second$^2$). However, for practical purposes with gravity being considered constant, the terms mass and weight are often used interchangeably albeit technically different.

The front and rear bolt pieces 50-1, 50-2 may be detachably coupled together in one embodiment as shown using a common coupling interface. A detachable keyed coupling may be provided in one embodiment formed by a male coupling feature on the front or rear bolt piece which creates a releasable interlock with a female coupling feature on the other one of the front or rear bolt piece. In one non-limiting embodiment, the male coupling feature may be a coupling protrusion 50-3 on the front of the rear bolt piece which forms the "key" and the female coupling feature may be a complementary configured coupling recess 50-4 formed on the rear of the front bolt piece which forms the "keyway." Coupling protrusion 50-3 slideably engages the complementary configured coupling recess 50-4. Any suitable configuration of coupling protrusion and recess may be used so long as the front bolt piece is axially interlocked to the rear bolt piece (i.e. the pieces cannot be axially separated in the longitudinal direction).

In one embodiment, coupling protrusion 50-3 may be U-shaped and coupling recess 50-4 may be a corresponding U-shaped channel which lockingly engages the protrusion when inserted. The coupling protrusion and recess may have a polygonal cross-sectional configuration in one embodiment which includes 90 degree corners. Other interlocking cross-sectional shaped may be used. The coupling protrusion 50-3 and coupling recess 50-4 in one embodiment may be formed as integral unitary parts of the front and rear bolt pieces 50-1, 50-2 which may each have a monolithic structure. The coupling protrusion 50-3 may comprise an upwardly and laterally projecting flange which is vertically oriented as shown in one embodiment. Correspondingly, the U-shaped channel may be downwardly open such that the flanged protrusion is inserted upwards into the channel of the front bolt piece 50-1. Alternatively, the U-shaped may be upwardly open and the coupling protrusion flange may project downwardly and laterally to each side.

When these keyed male and female coupling features of the front and rear bolt pieces 50-1, 50-2 are mutually engaged, the two pieces are axially interlocked together to prevent separation in the longitudinal direction when the bolt assembly 50 is axially moved (i.e. cycled) in receiver 21 between the rearward open breech position and forward closed breech position in battery with the barrel. In other embodiments, the keyed coupling features may be reversed such that coupling protrusion 50-3 may instead be disposed on the rear of front bolt piece 50-1 and the coupling recess 50-4 (e.g., channel) may be disposed on the front of rear bolt piece 50-2. Either arrangement may be used and does not limit the invention.

It bears noting that the front and rear bolt pieces physically restrained from separation when positioned in internal cavity 40 of receiver 21. In the axial (longitudinal) direction, the two bolt pieces are keyed into one another by the interlocked coupling protrusion and recess thereby axially preventing separation. The bolt assembly once mounted in receiver 21 is also vertically restrained from separation being disposed between the receiver above and fire control insert 23-1 below. As a result, there are no fasteners or screws required to hold the front and rear bolt sections together in the present embodiment when the bolt assembly is mounted in the firearm.

For convenience of general reference, the collective assembled bolt (bolt assembly) 50 (with front bolt piece 50-1 coupled to rear bolt piece 50-2) includes a front end 52, rear end 53, top 56, bottom 57, and a pair of longitudinally-extending opposing right and left lateral sides 58 defined by sidewalls of the bolt body. A majority of the sides 58 may be planar in some embodiments. For the illustrated two-piece bolt construction, these foregoing general positional locations refer to the assembled bolt, not each bolt piece alone.

Figure 38:
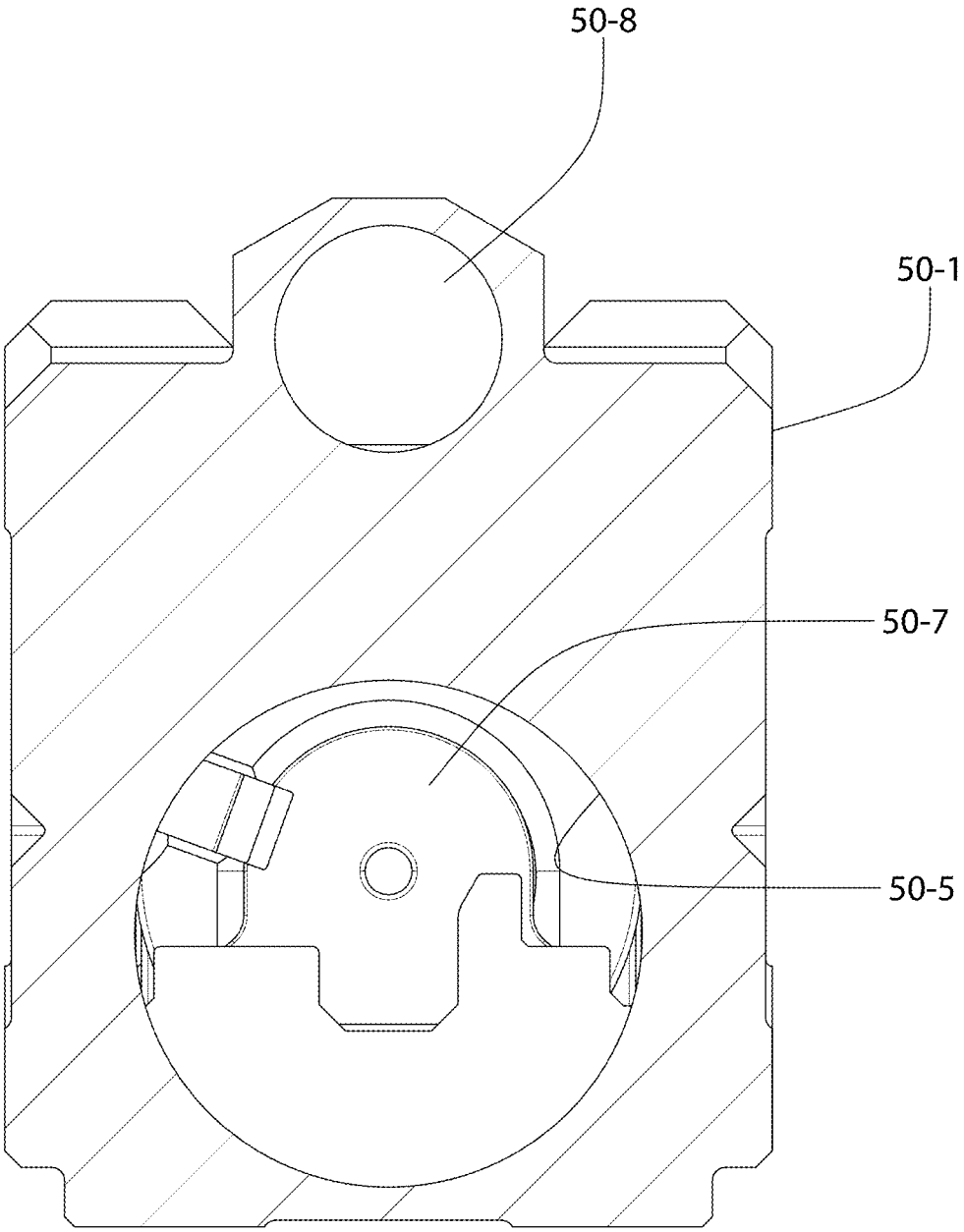
FIG. 38 is a first transverse cross-sectional view taken from FIG. 36 through the front bolt piece.
Figure 39:
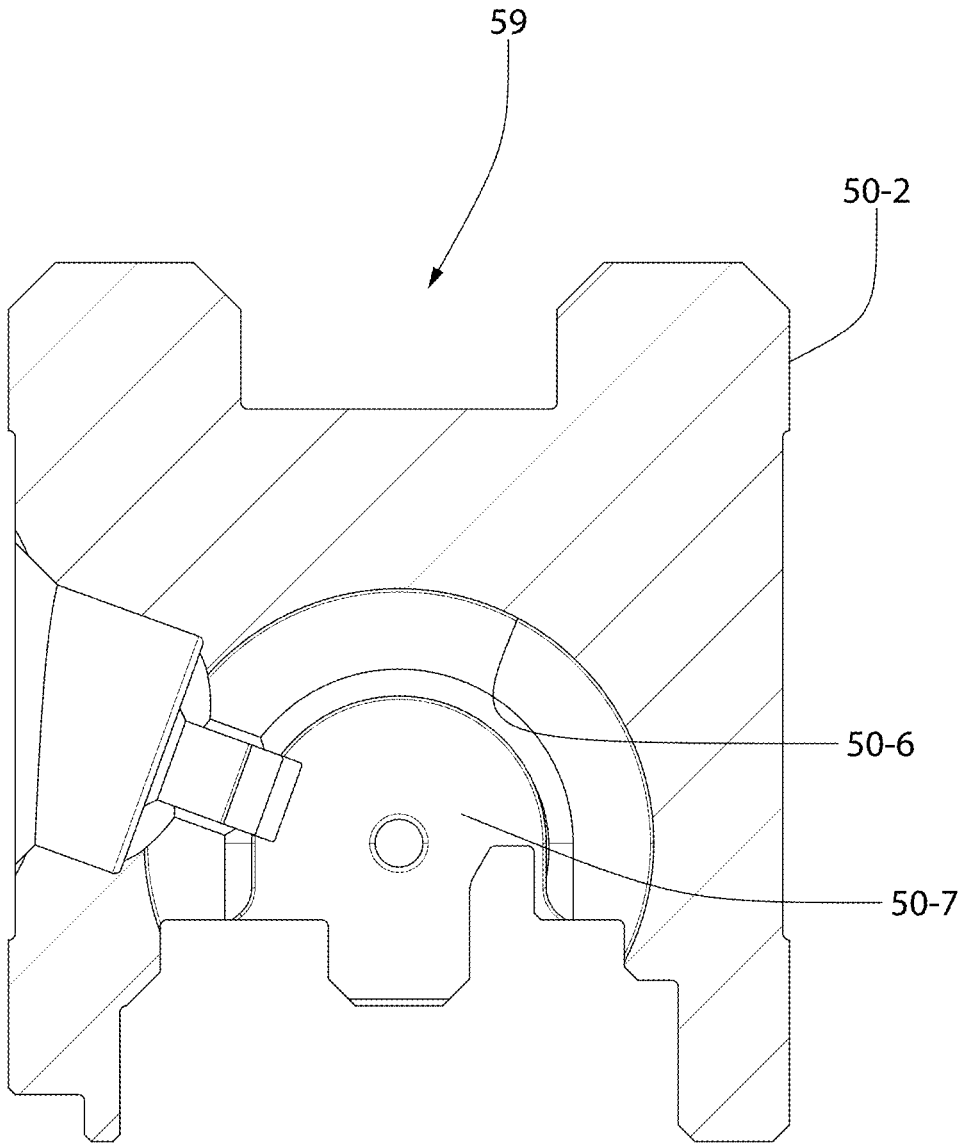
FIG. 39 is a second transverse cross sectional view taken from FIG. 37 through the rear bolt piece.
Figure 40:
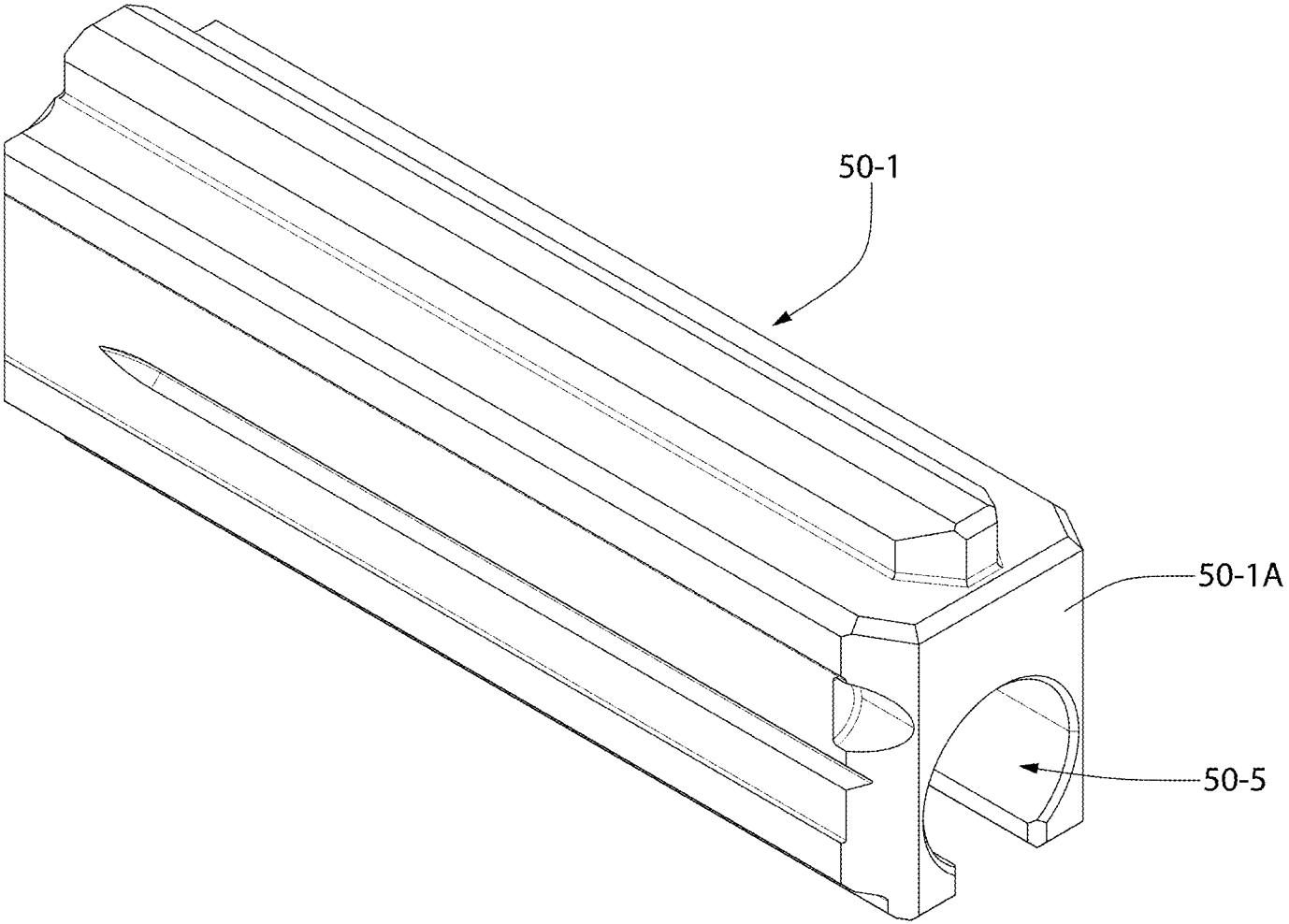
FIG. 40 is a front perspective view of the front bolt piece of the bolt assembly of FIG. 34.
Figure 41:
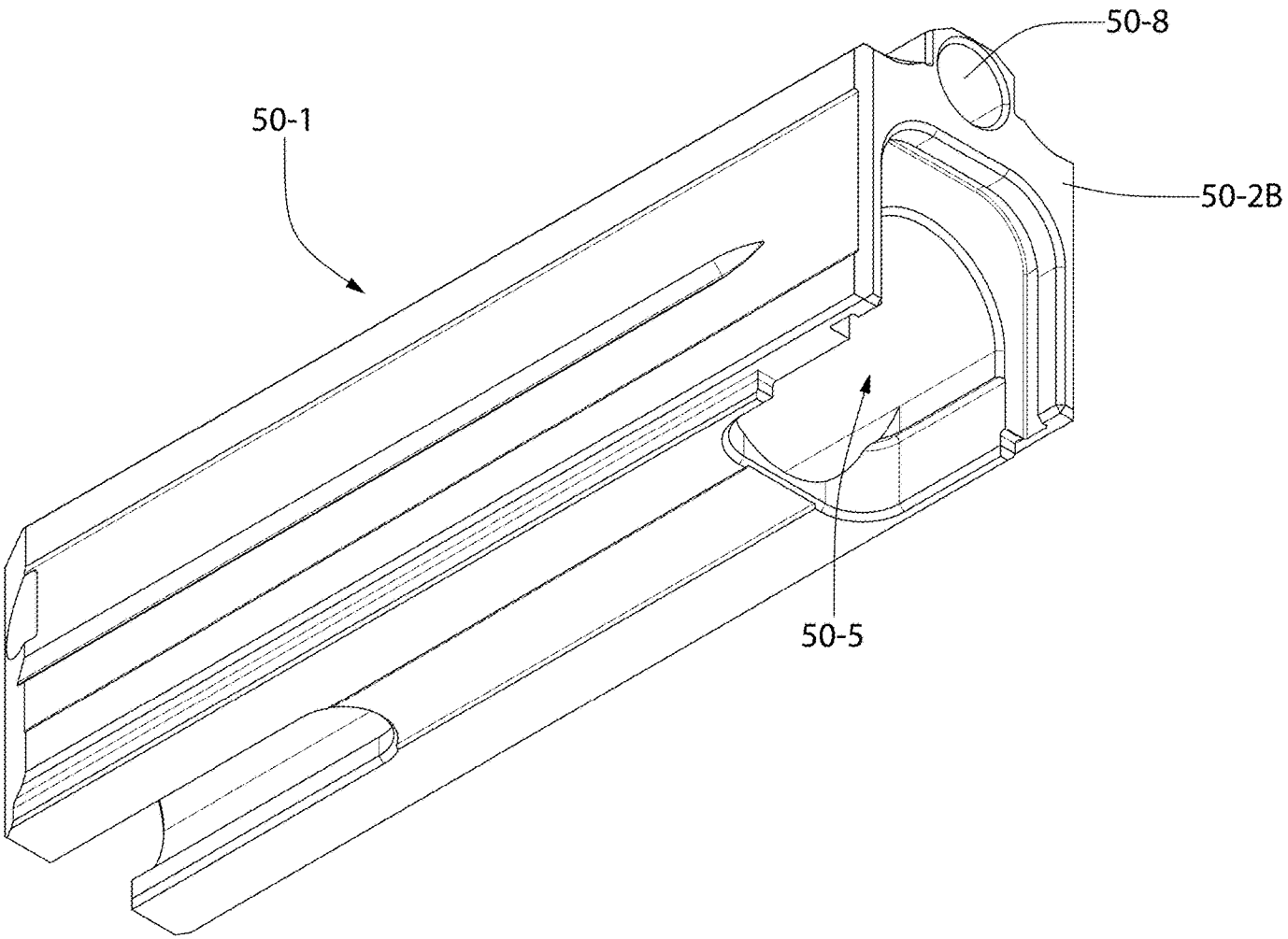
FIG. 41 is a rear perspective view thereof.
Figure 42:
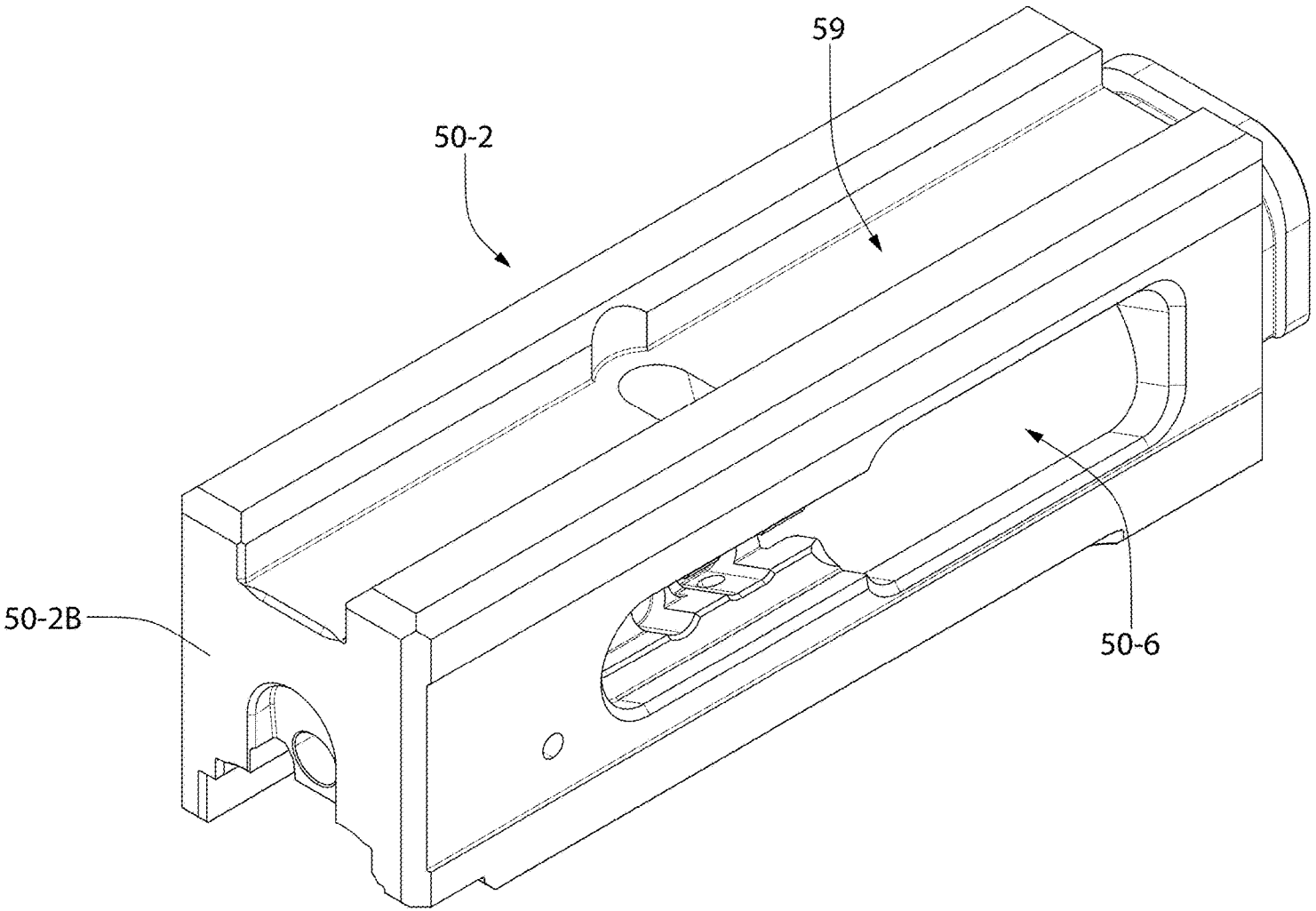
FIG. 42 is a front perspective view of the rear bolt piece of the bolt assembly of FIG. 34.
Figure 43:
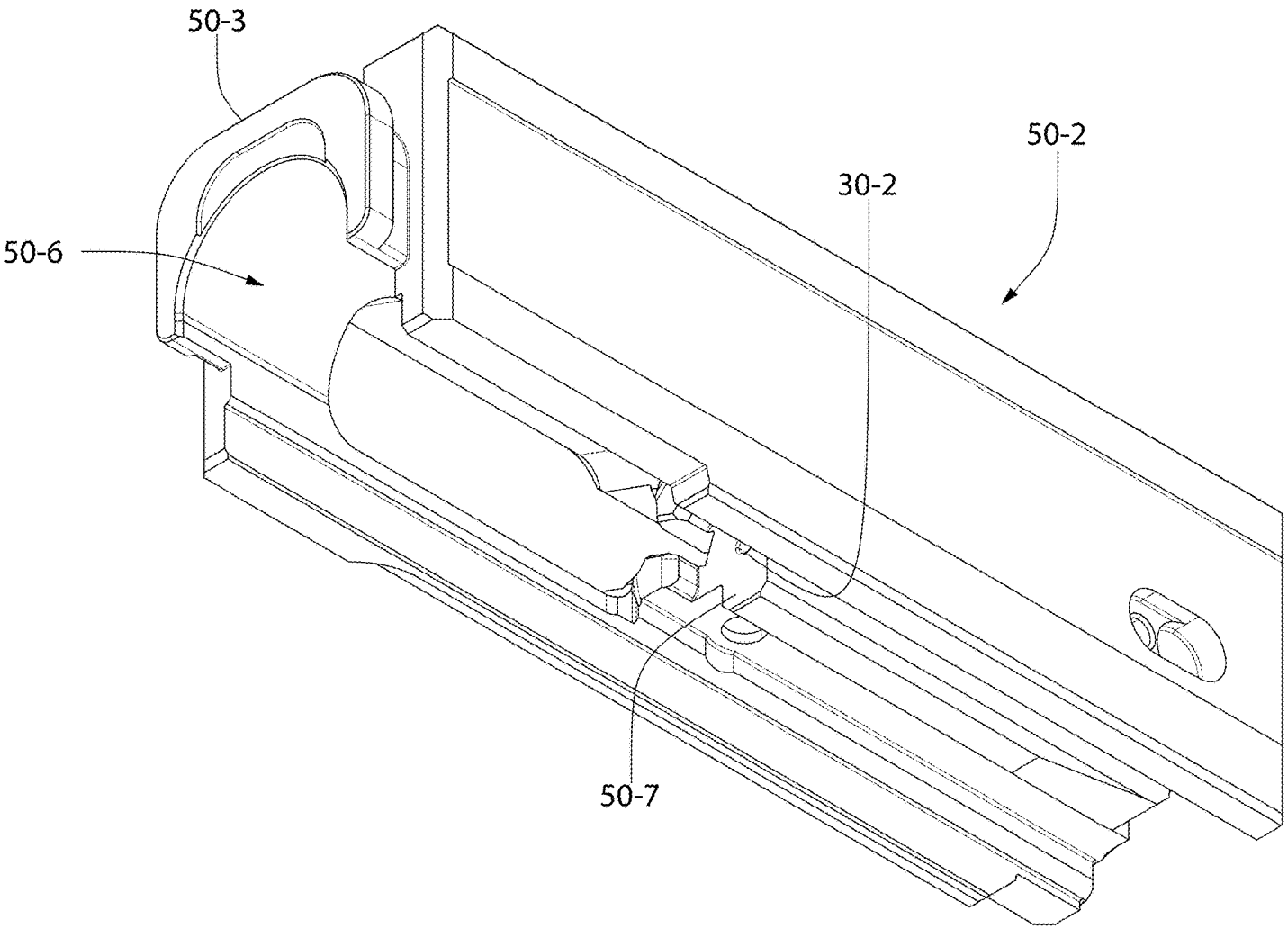
FIG. 43 is a rear perspective view thereof.

Front and rear bolt pieces 50-1, 50-2 of bolt 50 each comprise a front and rear longitudinal passage 50-5, 50-6 respectively which are coaxial with longitudinal axis LA of the firearm. The rear breech end 38 portion of barrel 22 is insertable into the passages from the open front end of the receiver 21. Longitudinal front and rear passages 50-5, 50-6 may each comprise an at least partially circular arcuately curved cross-sectional shape in portions to conform to the circular outer surface of the rear breech portion of the barrel inserted therein (see, e.g., FIGS. 12-13 and bolt 50A in FIGS. 38-39). The longitudinal passages 50-5 and 50-6 collectively form a continuous extended longitudinal passage spanning between and having portions lying in each of the front and rear bolt pieces as shown.

The front longitudinal passage 50-5 extends completely through front bolt piece 50-1 between front end 50-1A and rear end 50-1B. The rear longitudinal passage 50-6 extends through front end 50-2A of rear bolt piece 50-1 and terminates rearward at a vertical breech face 50-7 disposed partway inside the longitudinal passage 50-6, which is spaced inward from front end 50-2A of the rear bolt piece (see, e.g., FIG. 13). Viewed another way, breech face 50-7 is located between the front and rear ends of rear bolt piece 50-2 and spaced forward from rear end 50-2B of rear bolt piece by a distance.

The foregoing barrel and bolt arrangement provides a bolt-over-barrel design. Extending the barrel 22 for a distance inside the receiver and bolt 50 via longitudinal passages 50-5, 50-6 advantageously allows the forward projected length of the barrel to be short for a carbine type firearm, as previously described herein. The vertical breech face 50-7 of the rear bolt piece 50-2 engages the rear breech end 38 of the barrel 22 adjacent the cartridge chamber 36 when the breech is closed. The bolt breech face 50-7 establishes a rear terminal end of the longitudinal passage 50-5 in the rear bolt piece.

Bolt 50 (i.e. bolt assembly) is received and axially slideably movable in the internal cavity 40 of the receiver 21 along longitudinal axis LA between forward closed breech and rearward open breech positions. In the closed breech position, the bolt 50 (i.e. breech face 50-7 of rear bolt piece 50-2) is in battery with the rear breech end 38 of barrel 22 to close the chamber 36 for firing. In the open breech position, the bolt is axially displaced rearward to allow a spent cartridge casing to be extracted from the barrel chamber and ejected, and for loading a fresh cartridge into the breech area of the receiver for chambering by the bolt when automatically returned forward to the closed breech position by the recoil spring assembly.

To facilitate sliding engagement with internal cavity 40 of receiver 21 and to support the each of the bolt pieces 50-1, 50-2, each of the front and rear bolt pieces may comprise a laterally spaced apart pair of downwardly-protruding linear bottom longitudinal support surfaces 59-1 (see, e.g., FIG. 13) configured to slideably engage the flat bottom surface in the cavity 40 of the receiver. The support surfaces 59-1 may extend for at least part of the axial length of the front and rear bolt pieces. In other embodiments, the bottom surfaces of the front and/or rear bolt pieces may be a planar.

The recoil spring assembly includes recoil spring 54 and longitudinally-extending spring guide rod 55 which supports and guides the spring. The spring may be a helical compression spring in one embodiment as shown. The rear end of guide rod 55 extends rearward beyond rear bolt piece 50-2 through upwardly open longitudinal recess 59 thereof and is affixed to the rear end of receiver 21 inside receiver longitudinal cavity 40 in a fixed position. The front end of guide rod 55 is slideably received inside axial guide rod passage 50-8 of the front bolt piece 50-1 and projectible forward and rearward in the passage when the bolt moves between its forward and rearward positions. In one embodiment, recoil spring 54 may act on rear end 50-1B of front bolt piece 50-1 alone at the rear entrance to the guide rod passage to bias the entire two-piece bolt assembly forward to the closed breech position. Cavity 40 of receiver 21 therefore has an axial length sufficient to provide the full range of motion necessary for the bolt 50 moving rearward under recoil to open the breech for extracting and ejecting a spent cartridge casing, and moving forward to the closed breech position for feeding a new cartridge into the barrel chamber 36 from the magazine 33.

Bolt 50 may also include a manual charging handle 51 affixed to one side of the bolt to manually cycle the bolt between its forward and rearward positions by hand thereby allowing a user to manually lock the bolt in the rearward open breech position using bolt catch 100, as further described herein. Handle 51 has a transversely elongated body and is laterally projected from one side of the firearm for grasping to cycle the action.

Firing pin 30 of the firing mechanism 23 is movably mounted in a longitudinally-extending firing pin channel 30-1 formed in the bolt body. In one embodiment, firing pin 30 is mounted in rear bolt piece 50-2. The rear end of firing pin 30 remains exposed at the rear end 53 of the rear bolt piece (see, e.g. FIG. 3) for striking by the hammer 25 to discharge the firearm via a trigger pull. The front end of firing pin 30 is axially projectible through firing pin opening 30-2 formed through the breech face 50-7 of rear bolt piece 50-2 to strike a chambered cartridge when the breech face is in battery with the rear breech end of barrel 22.

FIGS. 34-43 show an alternative embodiment of a bolt 50A (bolt assembly) in which the front and rear bolt pieces 50-1, 50-2 are slightly different in configuration. Bolts 50 and 50A are ostensibly the same with respect to the significant technical features described herein (e.g., bolt coupling/interlock system, breech face location, longitudinal passages, recoil spring rod passage, etc.). Physical overall shape of the front bolt piece in particular is slightly different. One additional difference is that the recoil rod passage 50-8 of front bolt piece 50-1 has a closed front end and open rear end for bolt 50A whereas this passage had open front and rear ends for prior bolt 50. Bolt 50A demonstrates that minor variations in the bolt shape are possible as may be needed to fit the internal geometry of the receiver cavity which holds the bolt while still retaining the key functional features and economies of the 2-piece bolt assembly for blowback operation previously described herein.

The manually actuated bolt release mechanism of the present invention and related method for operating the same will now be further described.

The bolt release mechanism comprises bolt catch 100 which cooperates and operably interfaces directly with the bolt 50 for locking and retaining the bolt in the rear open breech position, or releasing the bolt forward therefrom to close the breech. FIGS. 24-33 show details of bolt catch assembly in isolation. FIGS. 14-23 show the bolt catch assembly in association with the fire control insert 23-1 to which the bolt catch is operably mounted.

Bolt catch 100 in one embodiment is an assembly comprising bolt catch lever 101 and actuator plunger 120 which cooperates with the lever to form an ambidextrous bolt release. These components may be movably mounted to and supported by the fire control insert 23-1 of the firearm in one embodiment as shown.

Figure 11:
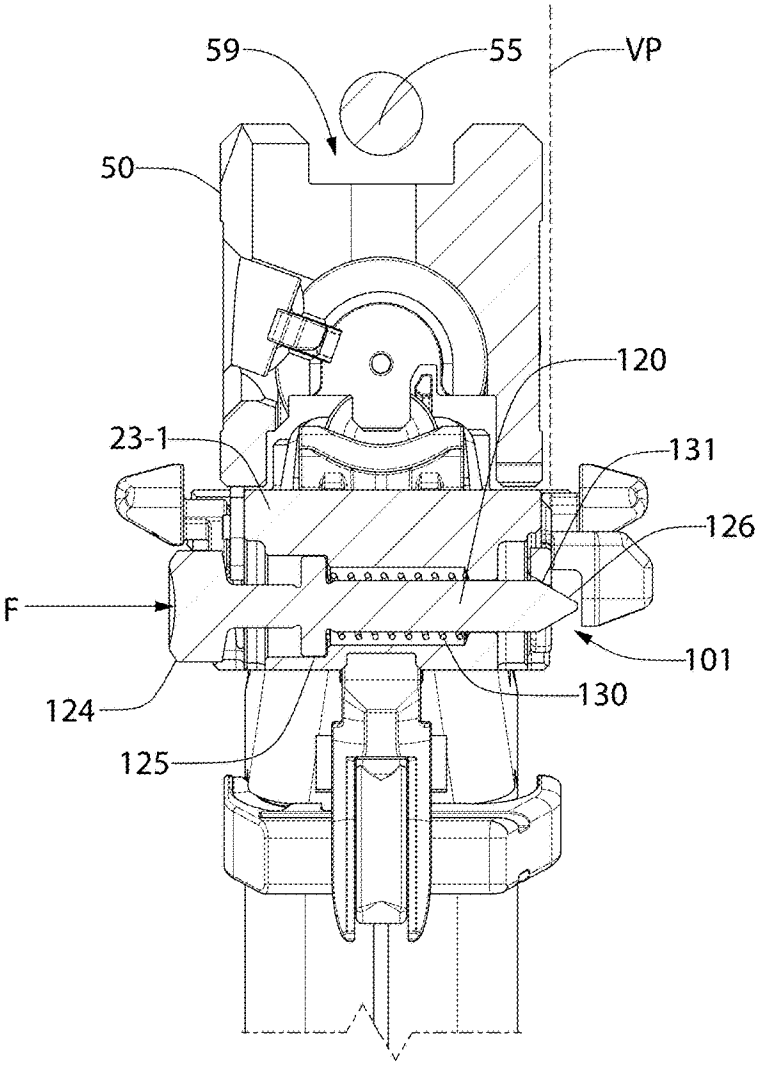
FIG. 11 is a transverse cross sectional view taken from FIG. 9A showing the actuator plunger of the bolt catch in an actuated position slideably engaged with and activating the bolt catch lever to cause rotation thereof to disengage and release the bolt.
Figure 10:
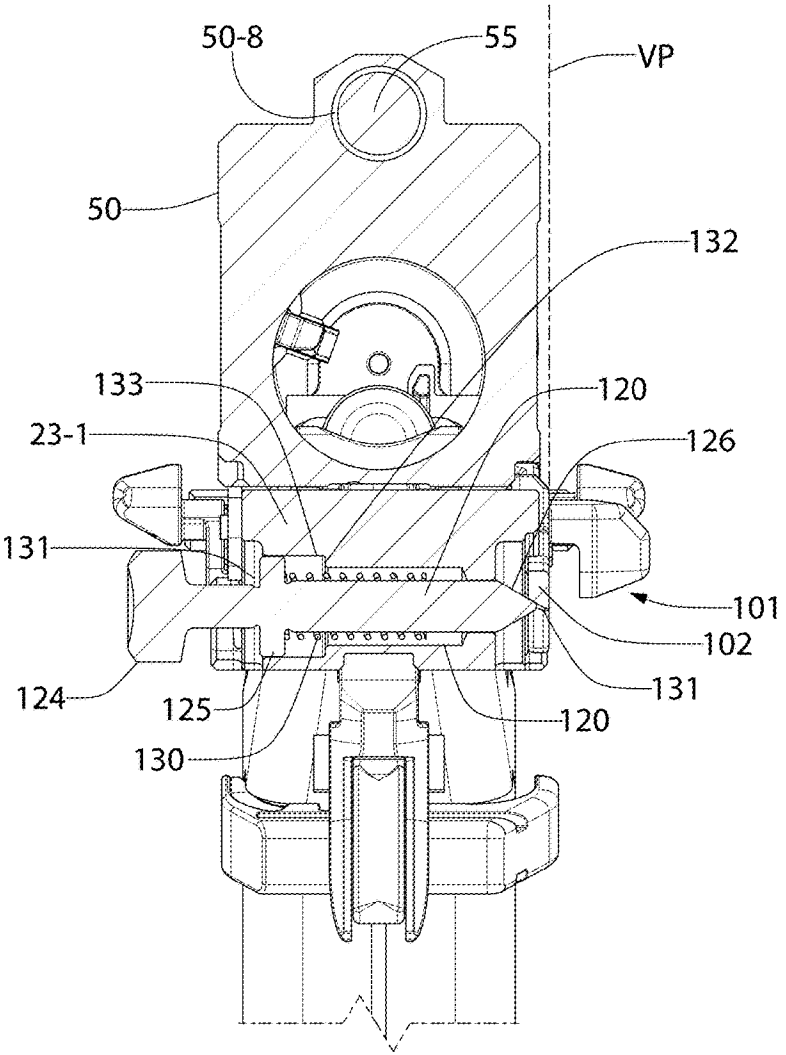
FIG. 10 is a transverse cross sectional view taken from FIG. 8A showing the actuator plunger of the bolt catch in an unactuated position which does not activate the bolt catch lever.
Figure 12:
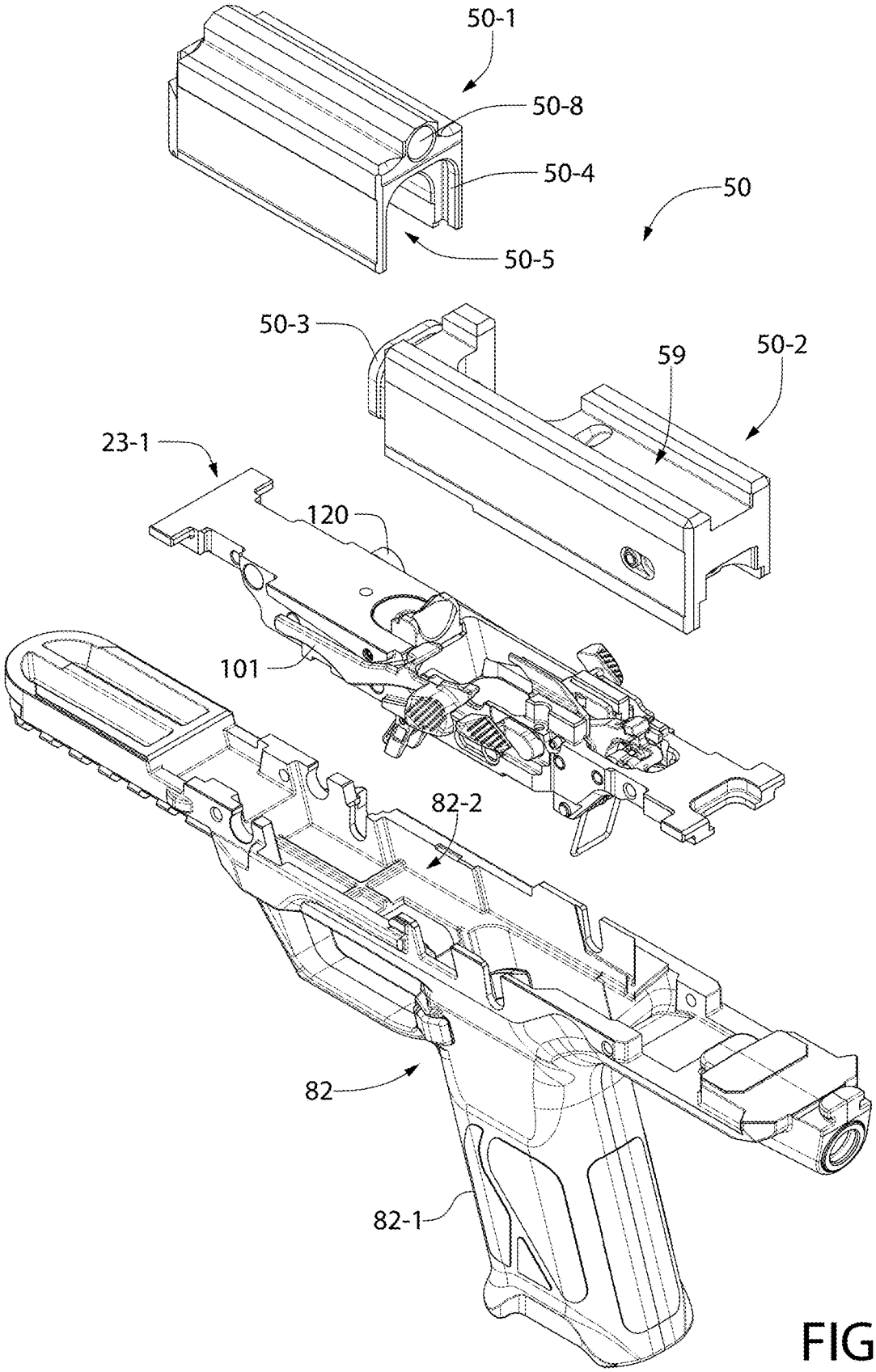
FIG. 12 is a top exploded perspective view of the bolt, fire control insert, and pistol grip frame of the firearm.

Bolt catch lever 101 comprises an elongated metallic body 100-1 which lies in a vertical reference plane VP oriented parallel to the sides of the firearm (see, e.g., FIGS. 10-11). The bolt catch lever 101 is movably disposed on one lateral side of the firearm (e.g., right lateral side 21-1 or left lateral side 21-2 of receiver 21 as shown). The bolt catch lever may be substantially axially elongated in the direction of the longitudinal axis LA of the firearm having an axial length which extends forward of trigger 24 in the fire control insert 23-1 at front and at rear laterally adjacent to central opening 115 of fire control insert 23-1 located directly above and in communication with magazine well 32, as further described herein. Bolt catch lever 101 is rotatable and pivotably movable about its horizontal and laterally oriented pivot axis PA upwards and downwards with toggle-like action in the vertical reference plane VP, as further described herein. The elongated extension of the bolt catch lever forward of pivot axis also provides the benefit of improving inertial balance of the lever, thereby contributing to a balanced and positively acting lever.

The bolt catch lever 101 is therefore vertically and pivotably movable about it pivot axis PA in the vertical reference plane VP relative to the bolt 50 and receiver 21 between an upward engaged position to lock and hold the bolt in its rearward open breech position, and a downward disengaged position which disengages and releases the bolt forward. Operation of the bolt catch 100 is further described elsewhere herein.

Bolt catch lever 101 generally defines a front end 102, rear end 103, exterior and interior sides 104, 105 extending therebetween, top 106, and bottom 107. Sides 104, 105 may be substantially flat portions of the body 100-1 (except for operating features) and parallel to each other in one embodiment as shown.

The operating features of bolt catch lever 101 generally includes a pivot pin 110 which pivotably mounts the lever to fire control insert 23-1, bolt catch protrusion 113 configured to selectively engage a mating locking ledge 114 formed on the bolt 50 to lock the bolt rearward with an open breech until manually released, actuating handle 111 for manually actuating the lever to either manually engage or release the bolt 50, and follower engagement protrusion 112 which is selectively engageable with the follower 33-1 of the magazine 33 as a last round bolt hold open feature after the last cartridge is dispensed to the firearm from the magazine which automatically locks the bolt in the rear open breech position. Each feature is further described below.

Pivot pin 110 extends perpendicularly to the bolt catch lever body 100-1 and transversely inwards from interior side 105 of the bolt catch lever 101 in a horizontal orientation. Pivot pin 110 in one non-limiting embodiments may be located in the middle portion of the lever body 100-1 between ends 102, 103, but not necessary at the midpoint therebetween as shown. Pivot pin 110 defines pivot axis PA of the lever 101 and may have a cylindrical configuration. Pivot pin 110 is rotatably received in a mating round pin mounting hole 110-1 formed in a lateral side of the fire control insert 23-1 to pivotably mount the bolt catch lever to the insert (see, e.g., FIG. 14).

Bolt catch protrusion 113 is configured to protrude both upwards and laterally/transversely inwards from interior side 105 of the bolt catch lever 101 from the rear portion 103-1 of the lever defined between pivot pin 110 and rear end 103. In one embodiment, as shown, bolt catch protrusion 113 may be disposed proximate to rear end 103 of the lever to maximize its vertical range of motion about the lever pivot axis PA. The bolt catch protrusion is configured to operably engage locking ledge 114 formed on the bolt 50 to lock the bolt in its rear open breech position when bolt catch lever 101 is either manually actuated by the user or automatically actuated via operation of the follower engagement protrusion 112 operably interfaced with the magazine as a last round hold open provision.

Figure 8A:
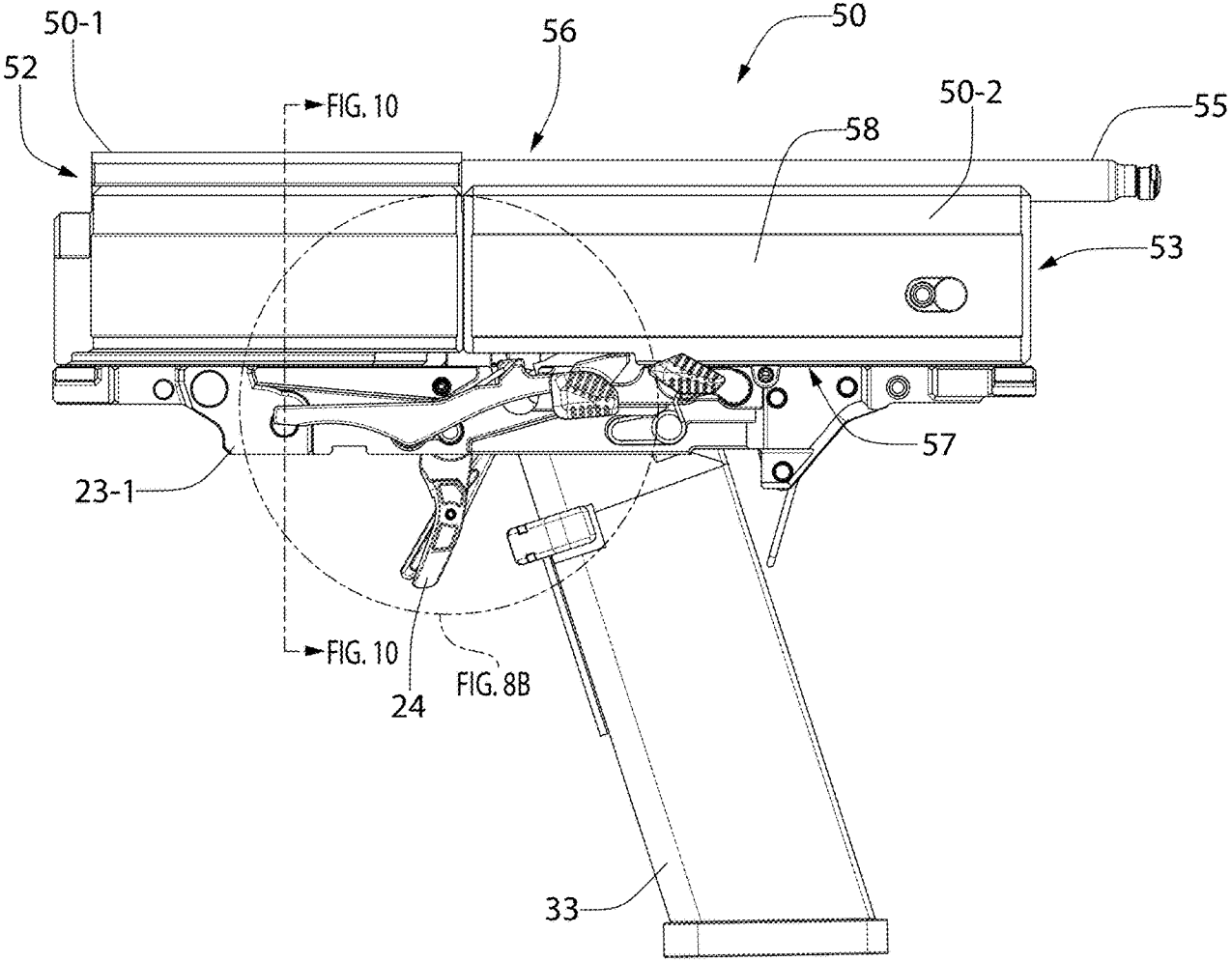
FIG. 8A is left side view of part of the firearm showing the bolt in a rearward open breech position and the bolt catch lever of the bolt catch engaged with the bolt to retain the open breech position.
Figure 8B:
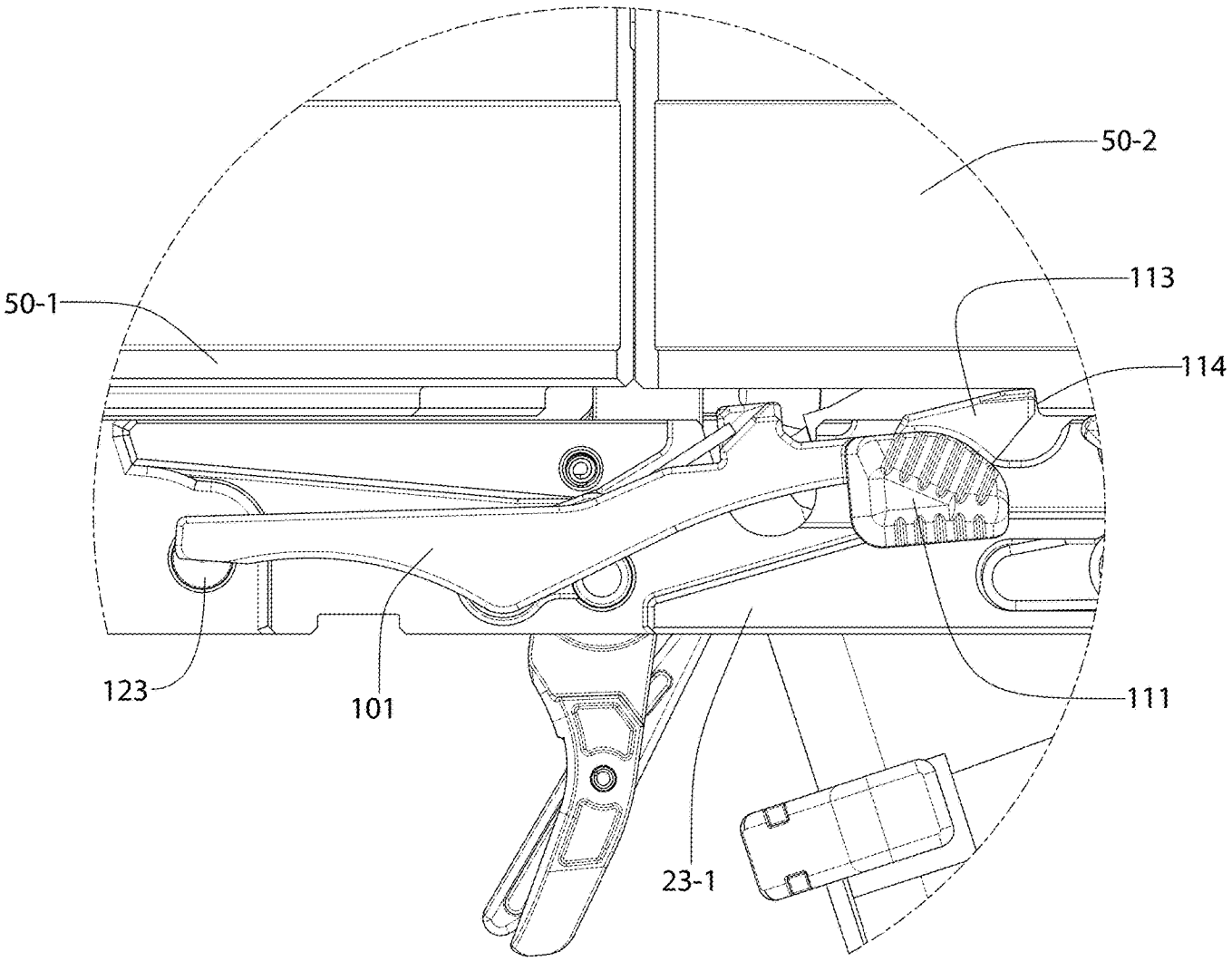
FIG. 8B is an enlarged detail taken from FIG. 8A.
Figure 9A:
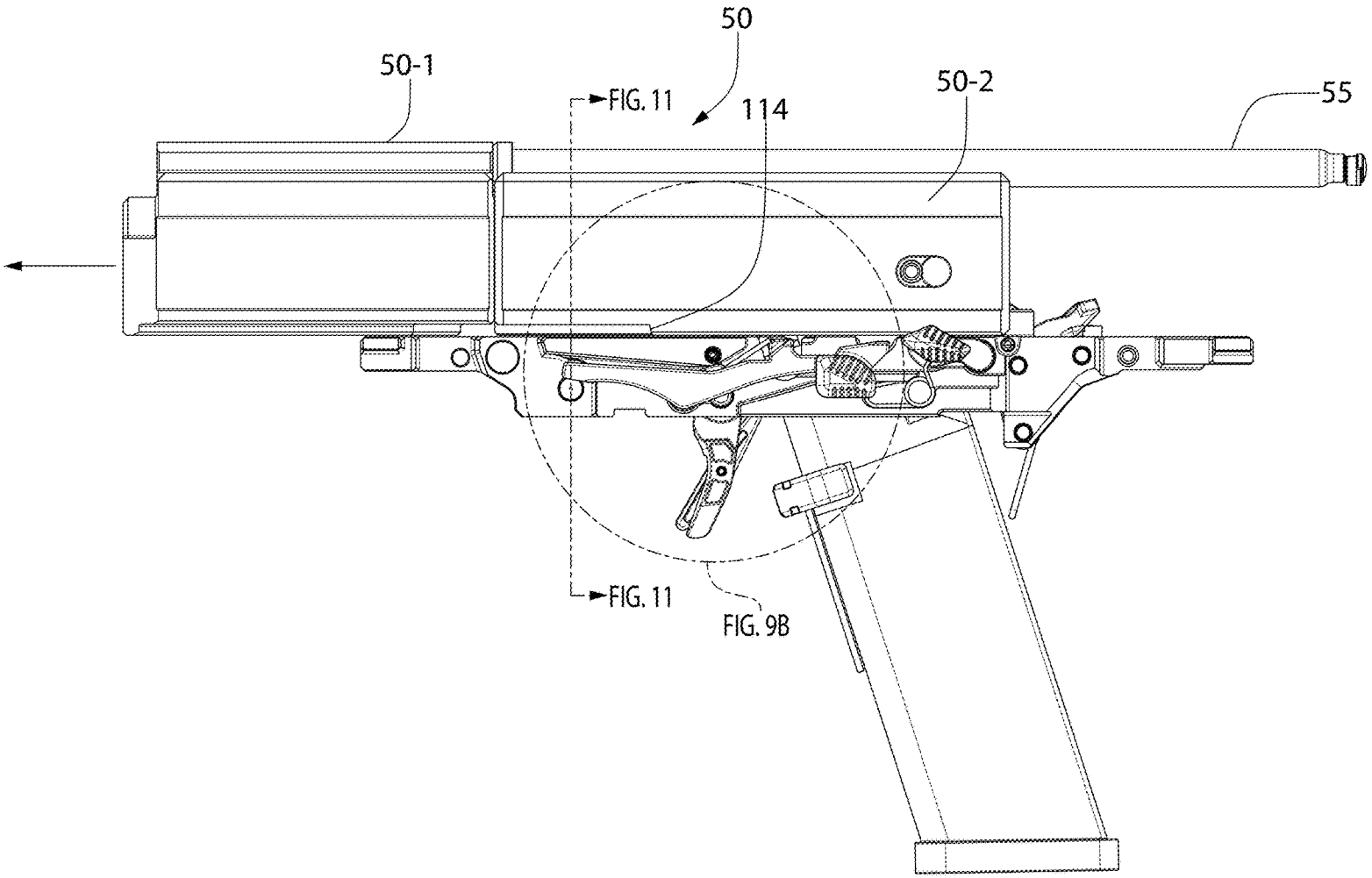
FIG. 9A is left side view of part of the firearm showing the bolt returning forward to the closed breech position and the bolt catch lever disengaged from and releasing the bolt.
Figure 9B:
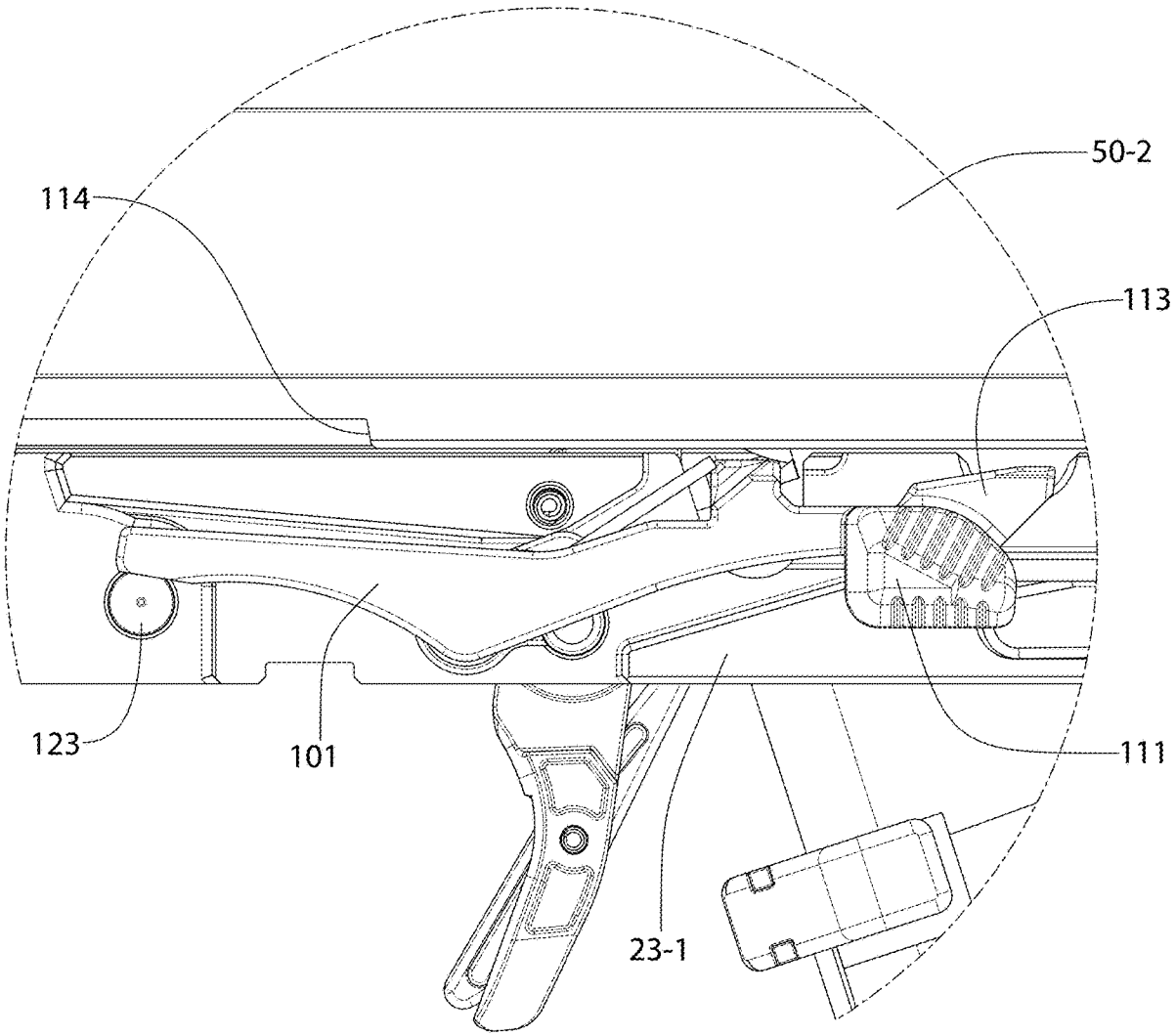
FIG. 9B is an enlarged detail taken from FIG. 9A.
Figure 13:
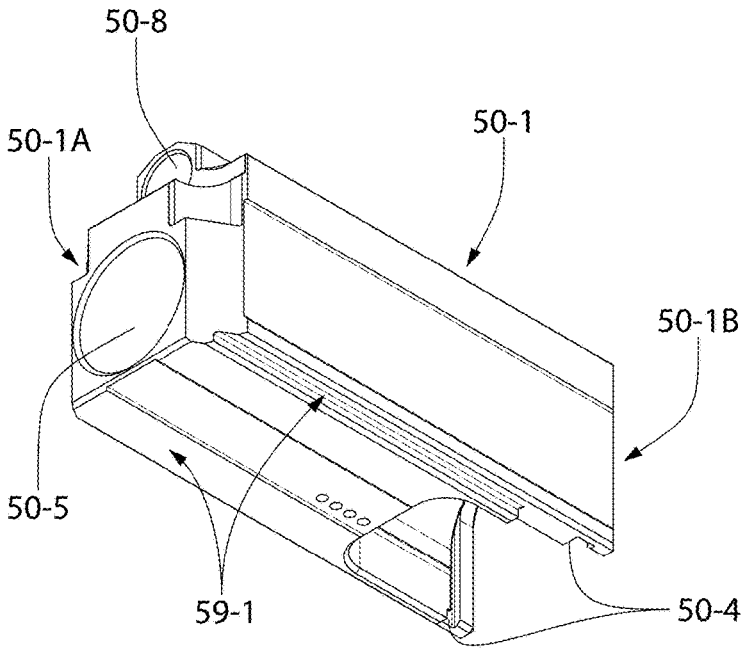
FIG. 13 is a bottom exploded perspective view of the bolt.
Figure 13:
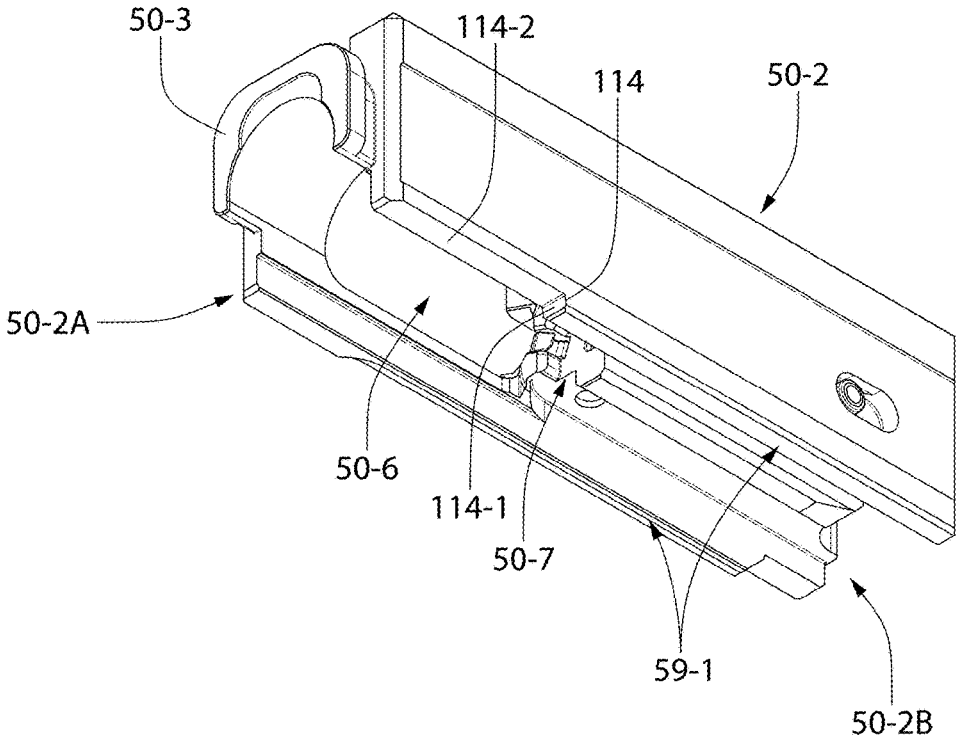
Figure 14:
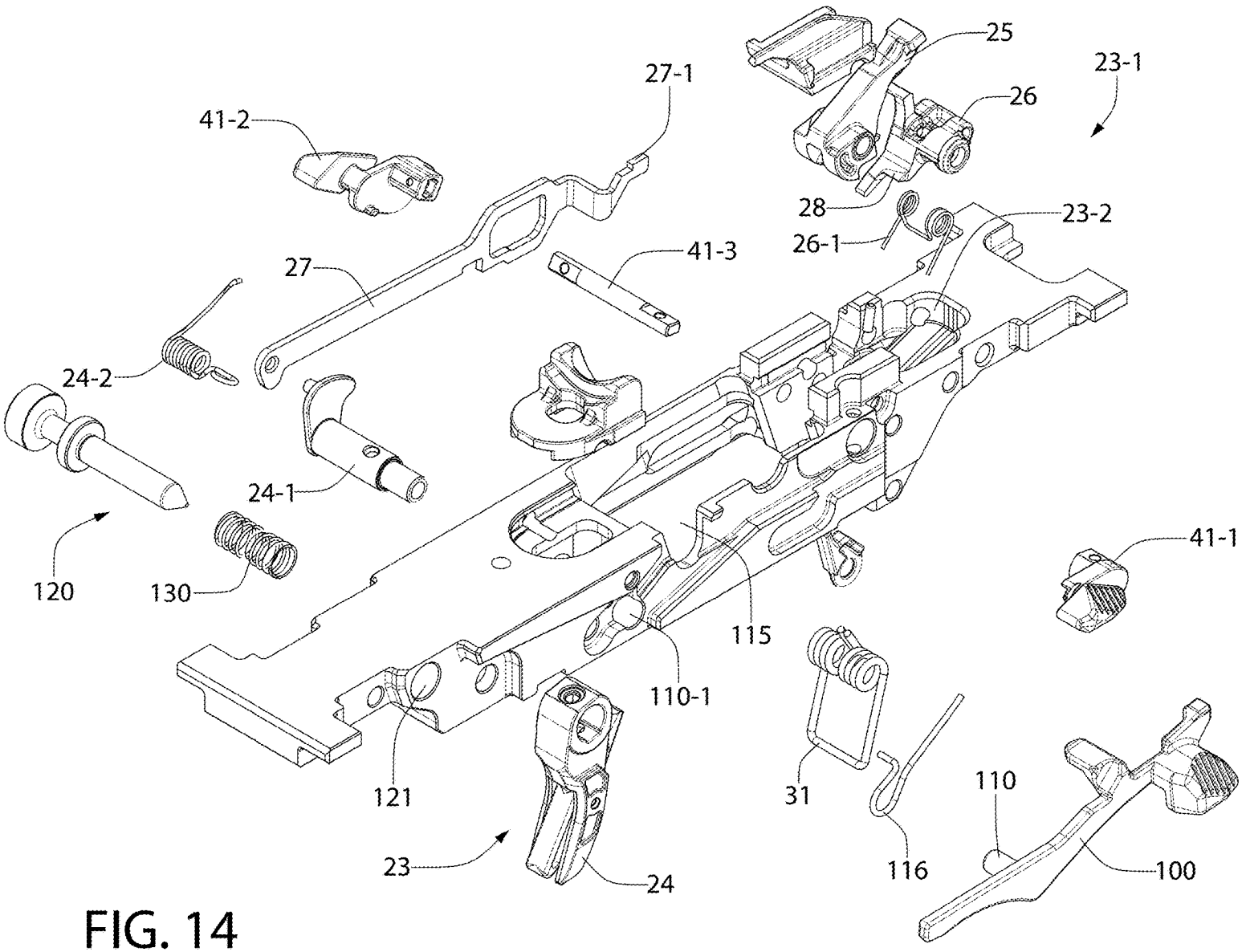
FIG. 14 is a top exploded perspective view of the fire control insert with firing mechanism components and the bolt catch mounted thereon.
Figure 15:
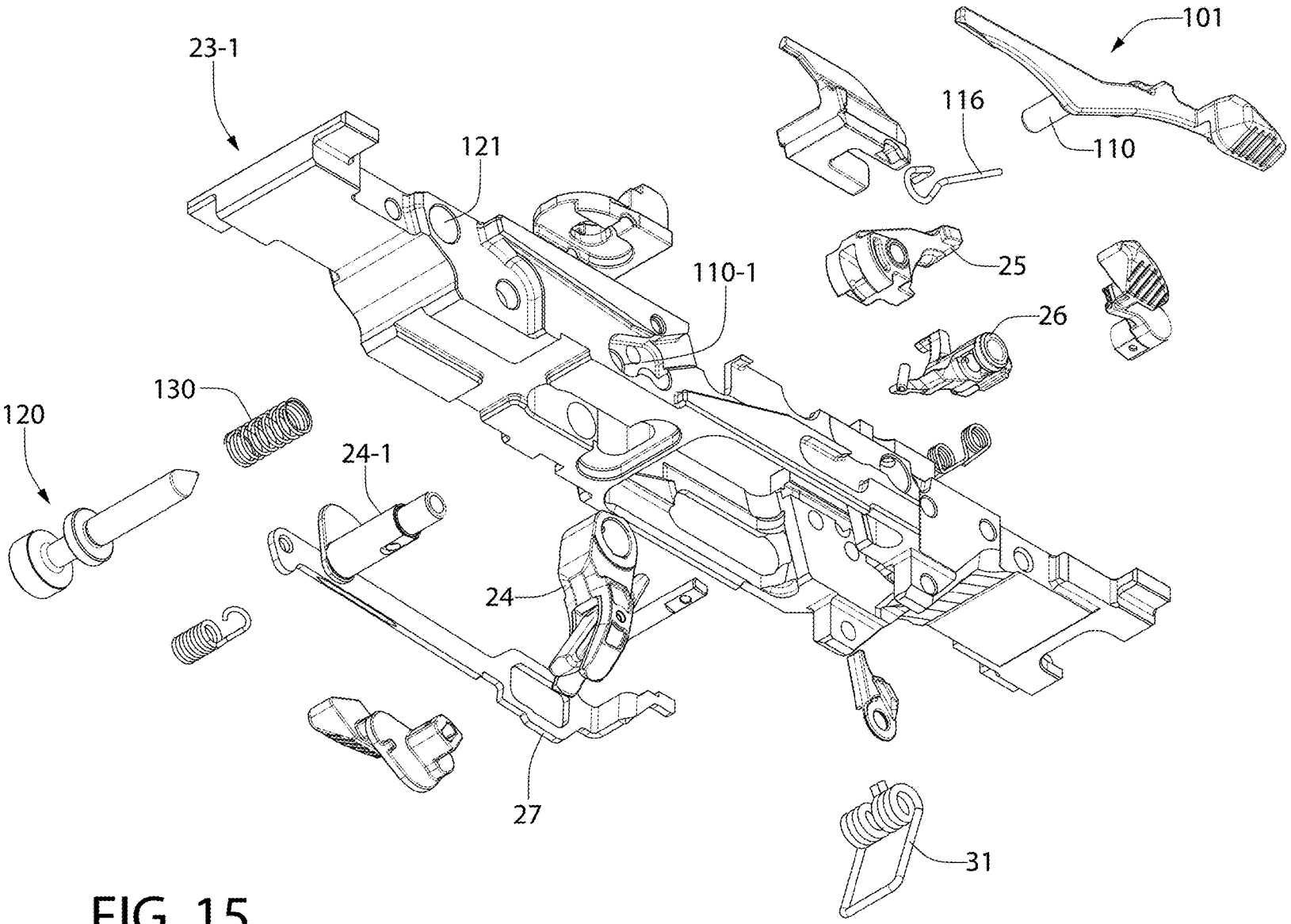
FIG. 15 is a bottom exploded perspective view thereof.
Figure 16:
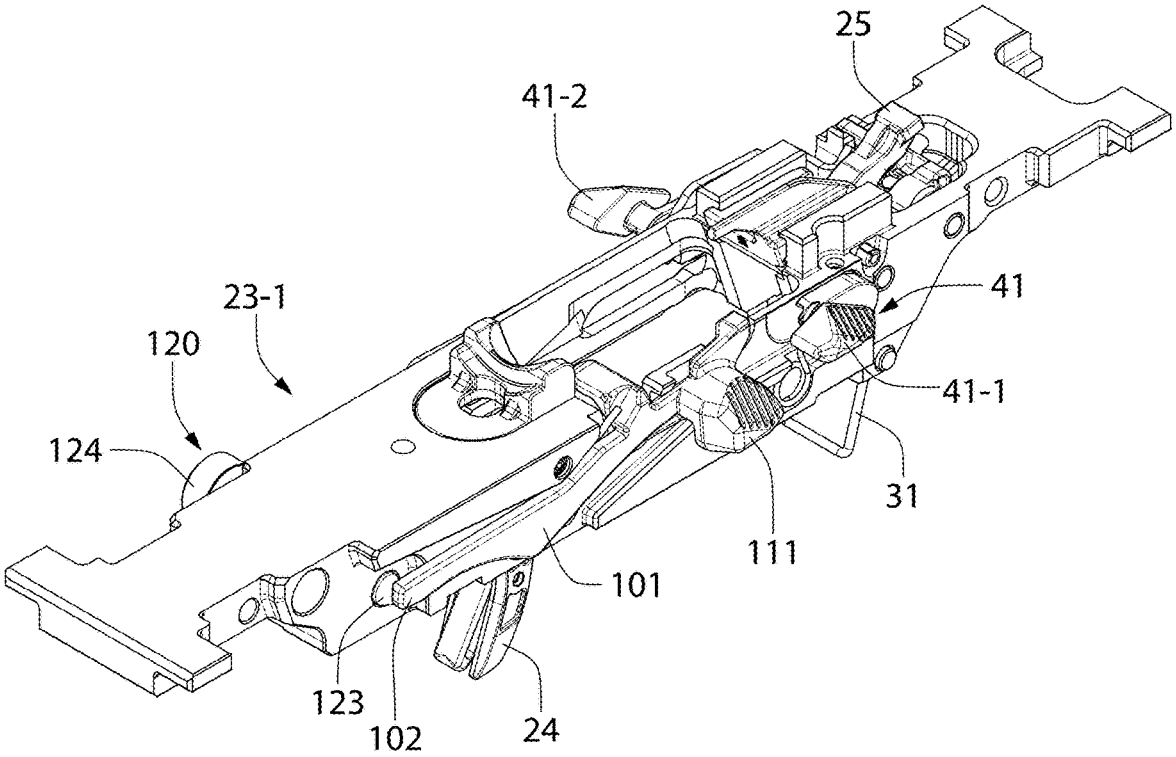
FIG. 16 is a top front assembled perspective view thereof.
Figure 17:
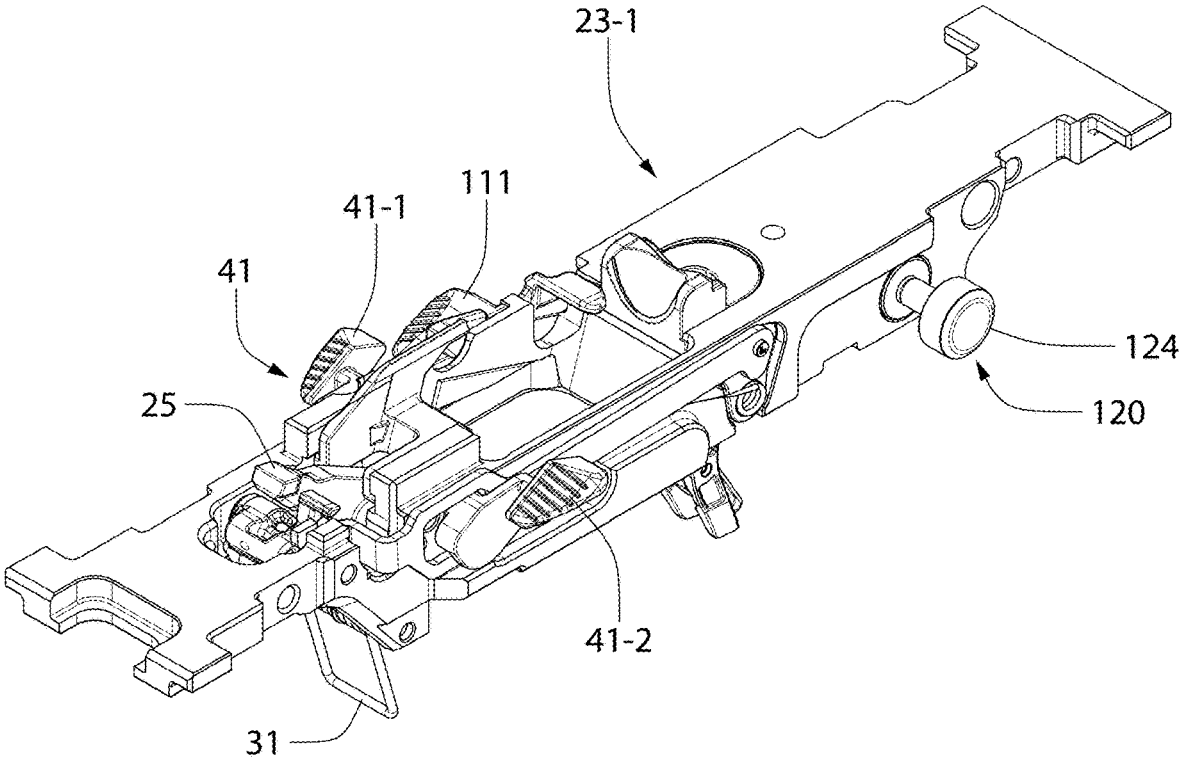
FIG. 17 is a first top rear assembled perspective view thereof.
Figure 18:
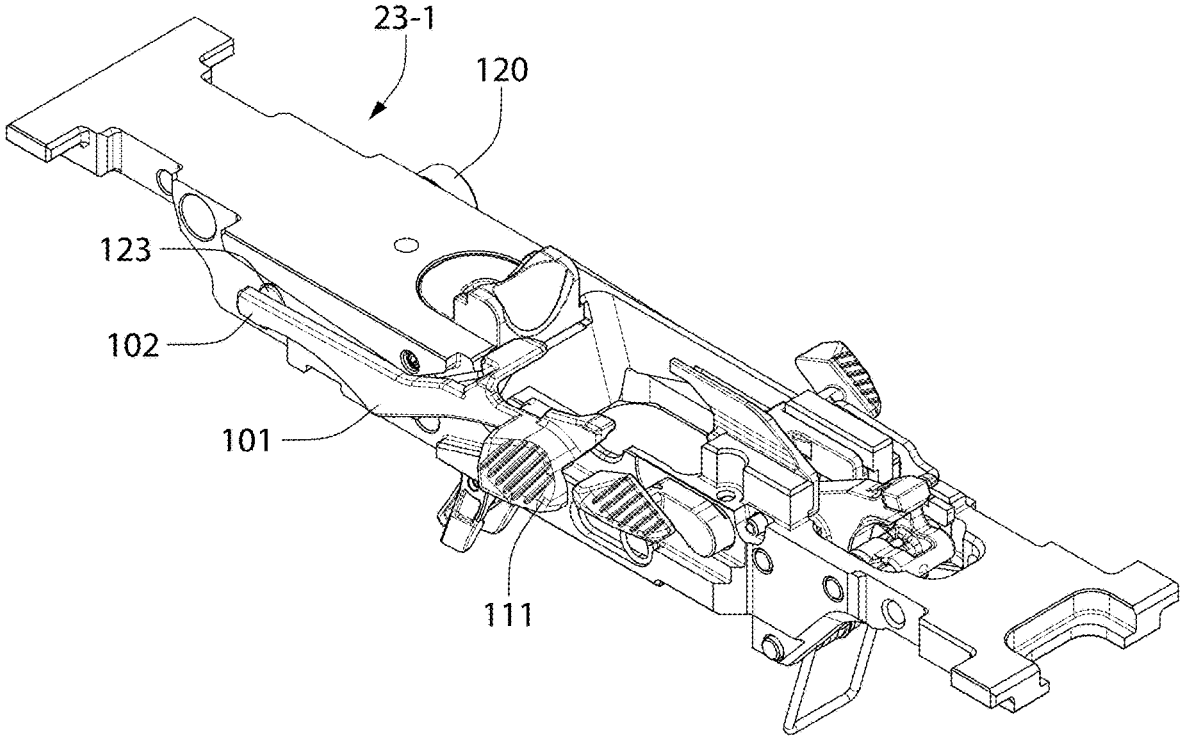
FIG. 18 is a second top rear assembled perspective view thereof.
Figure 19:
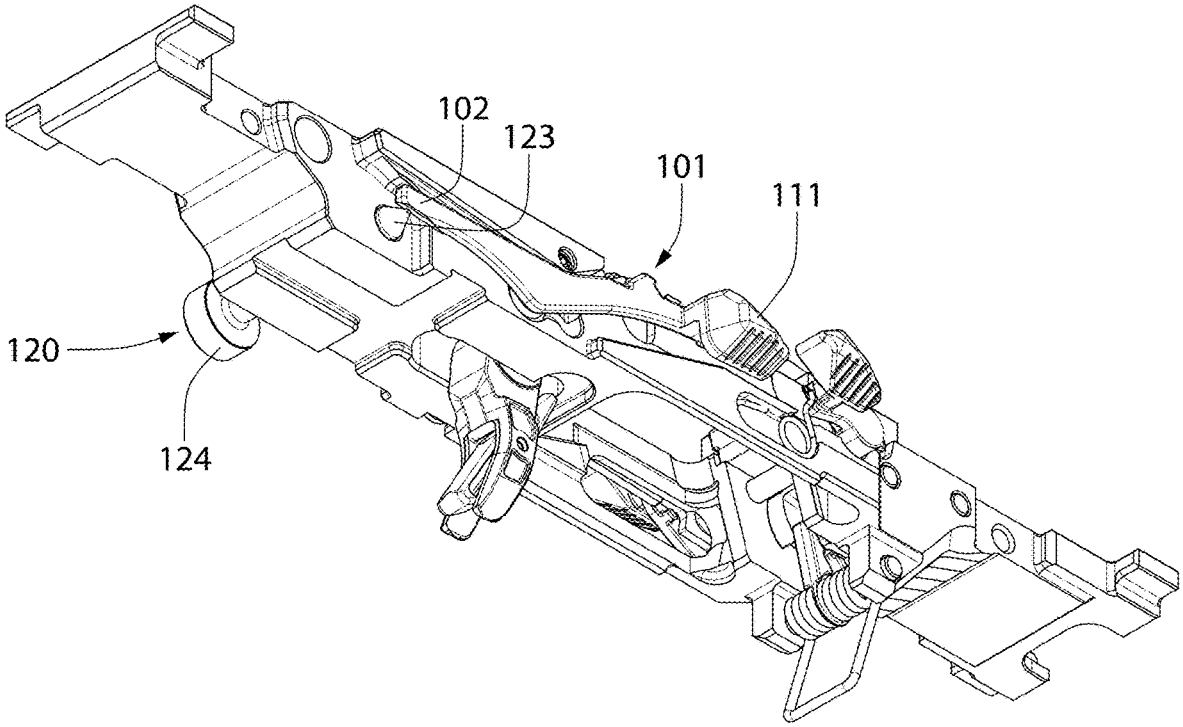
FIG. 19 is a bottom assembled perspective view thereof.
Figure 20:
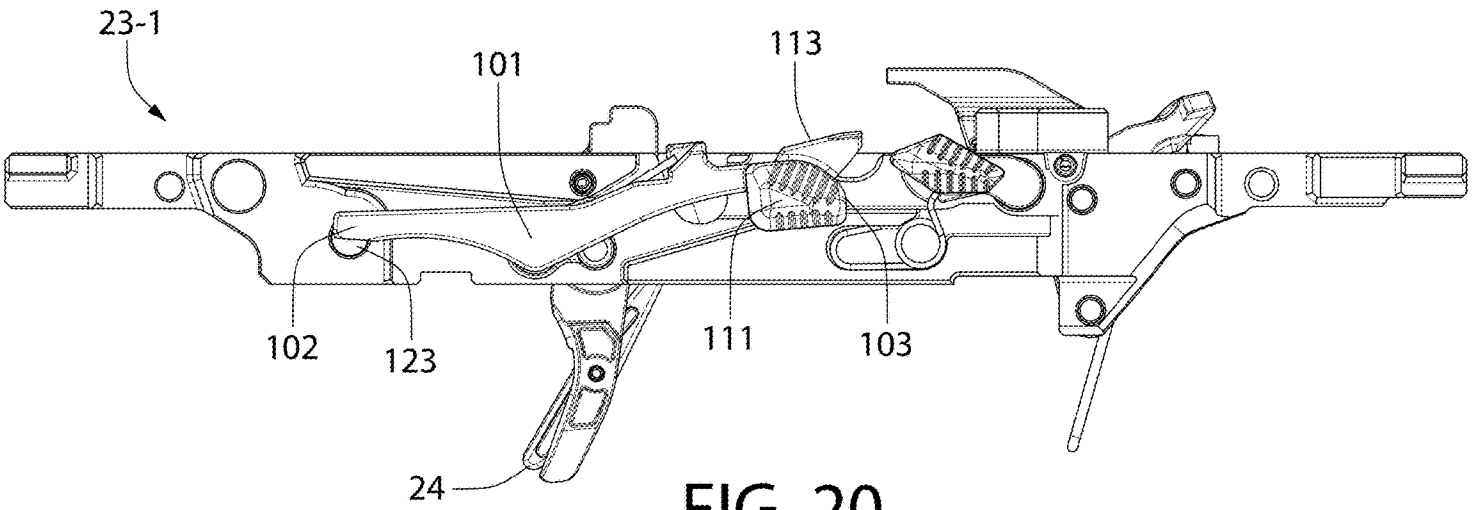
FIG. 20 is a left side view of the fire control insert.
Figure 21:
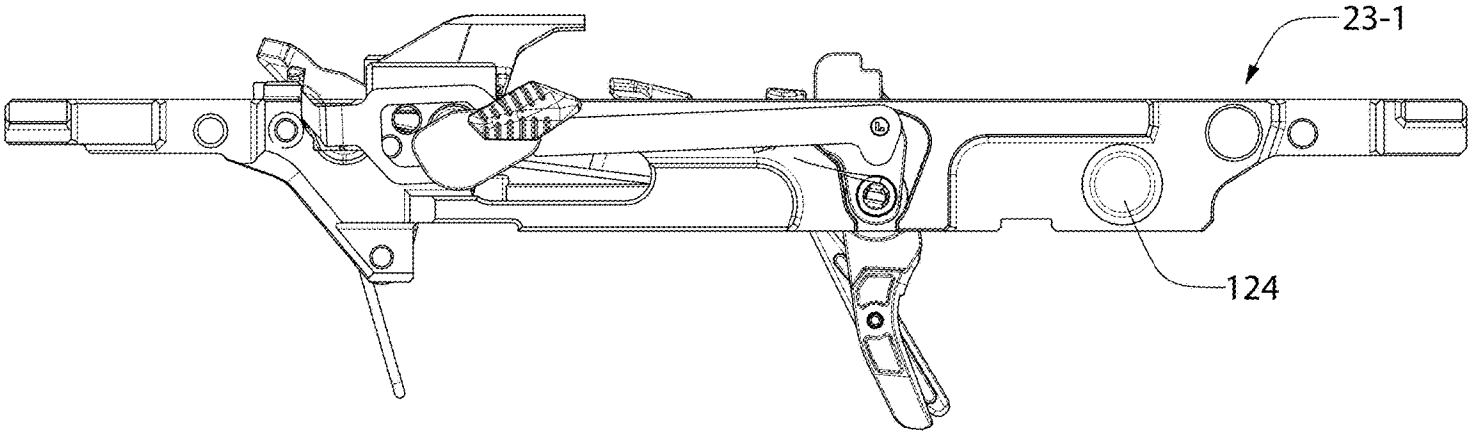
FIG. 21 is a right side view thereof.
Figure 22:
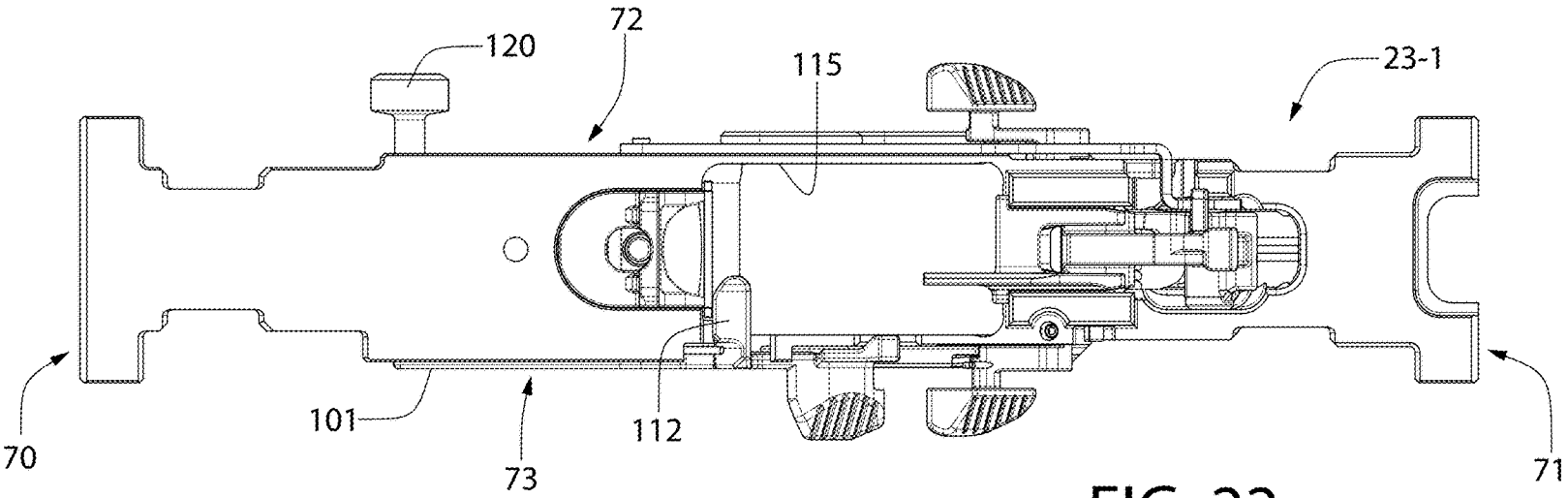
FIG. 22 is a top view thereof.
Figure 23:
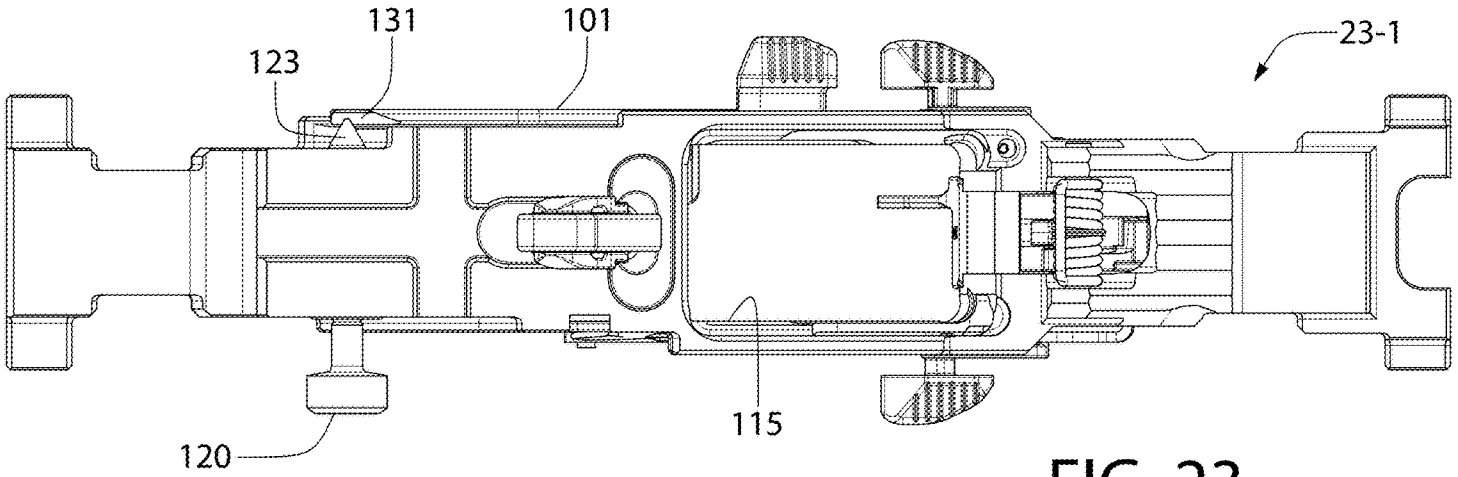
FIG. 23 is a bottom view thereof.
Figure 24:
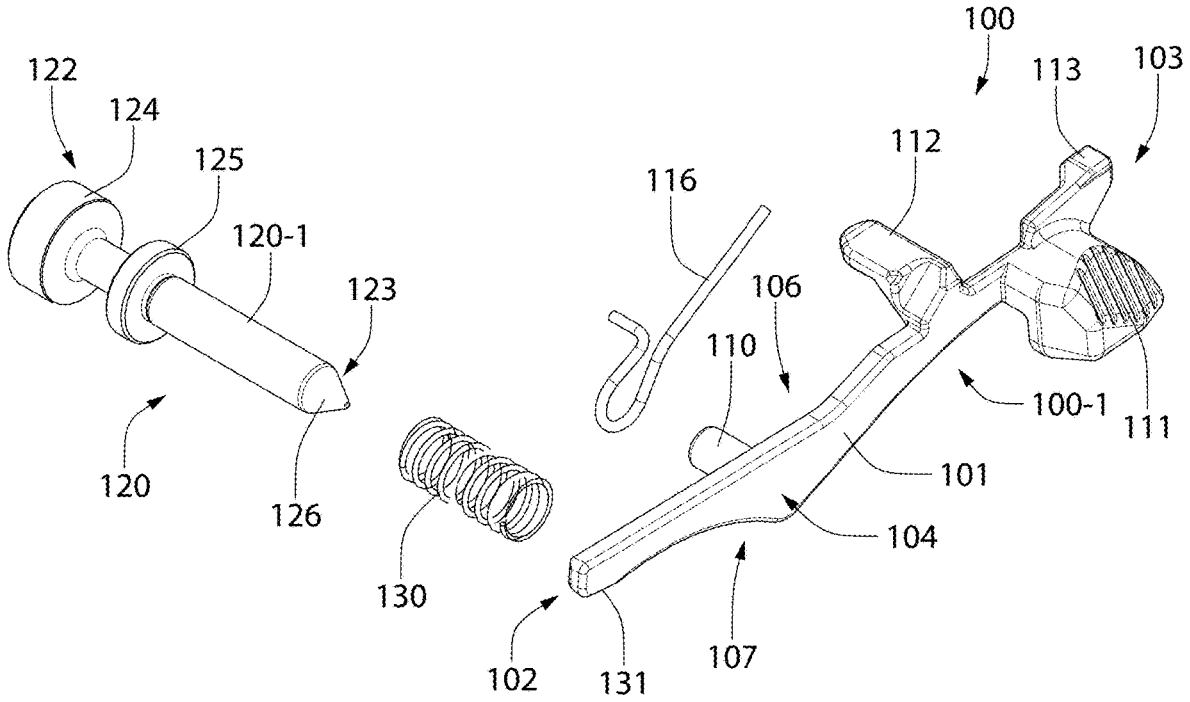
FIG. 24 is a first exploded perspective view of the bolt catch comprising the bolt catch lever and actuator plunger.
Figure 25:
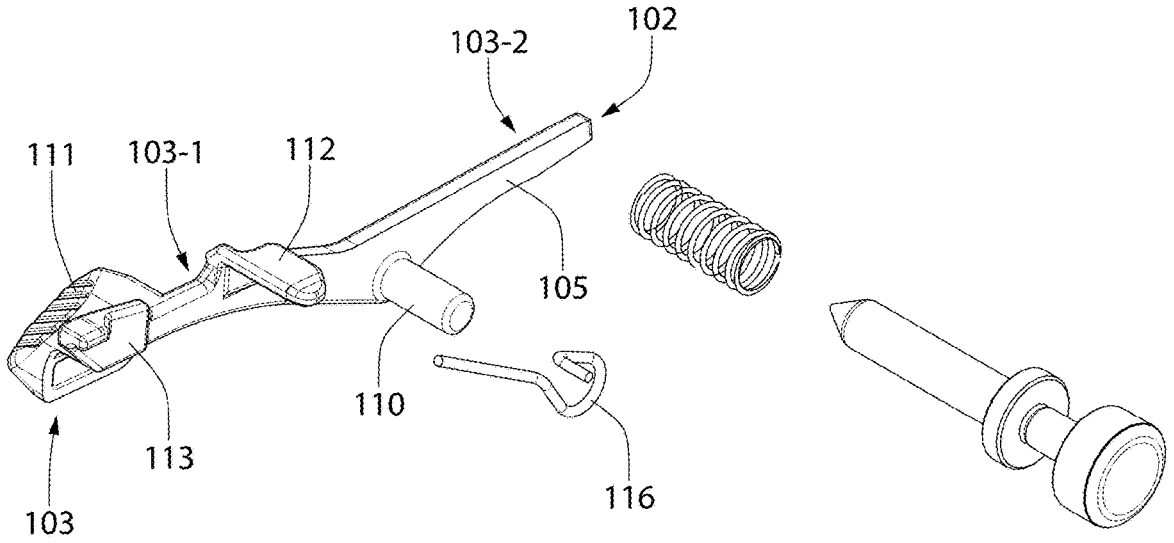
FIG. 25 is a second exploded perspective view thereof.
Figure 26:
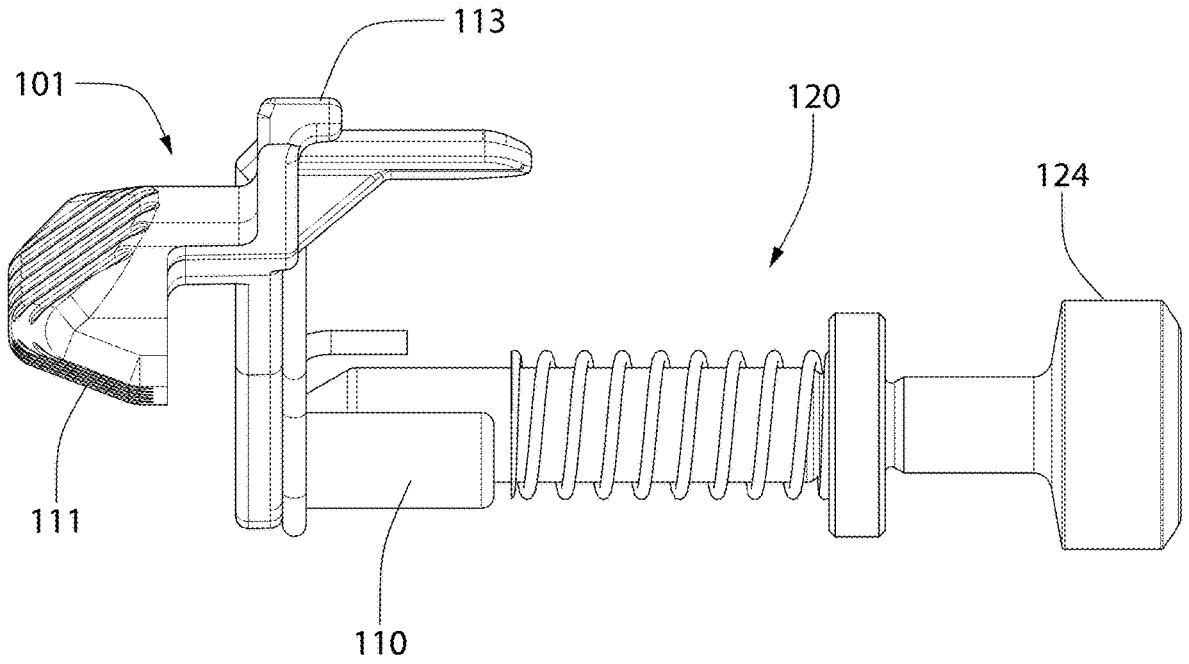
FIG. 26 is a rear view thereof in an assembled condition.
Figure 27:
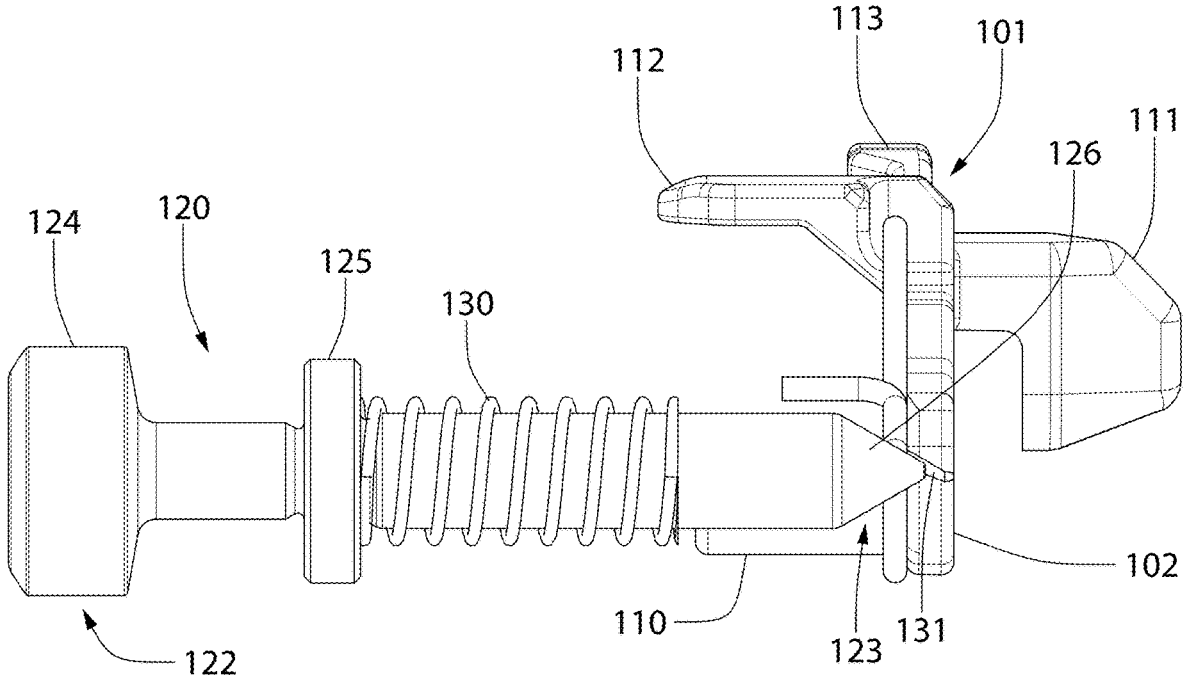
FIG. 27 is a front view thereof.
Figure 28:
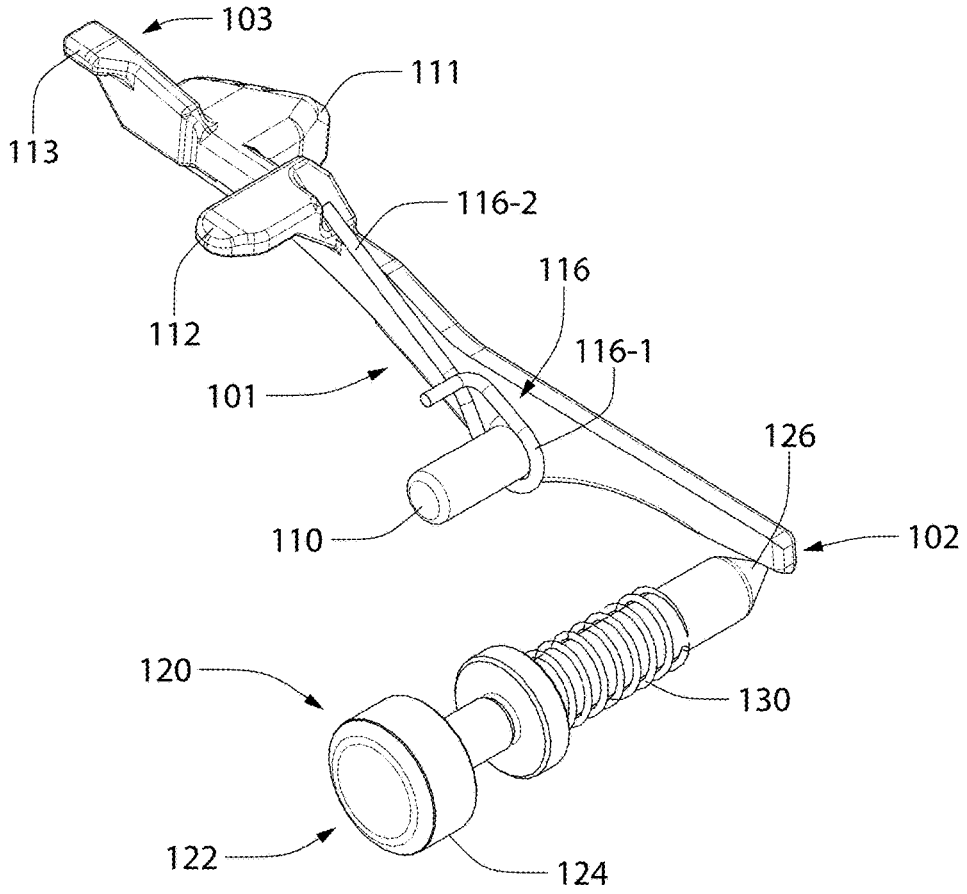
FIG. 28 is a top perspective view thereof.
Figure 29:
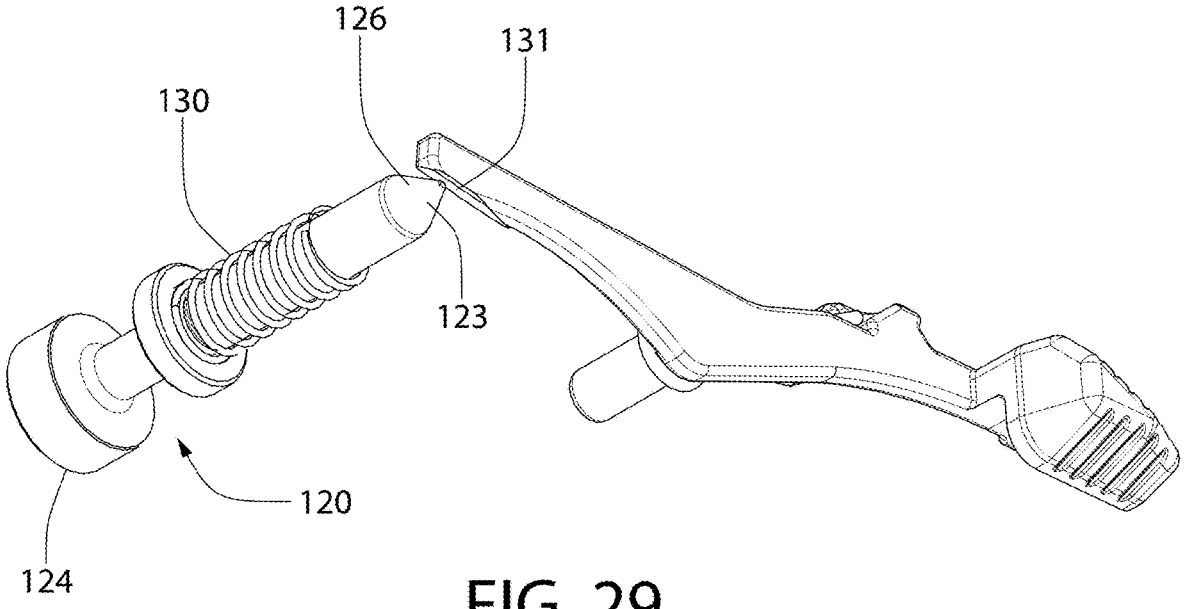
FIG. 29 is a bottom perspective view.
Figure 30:
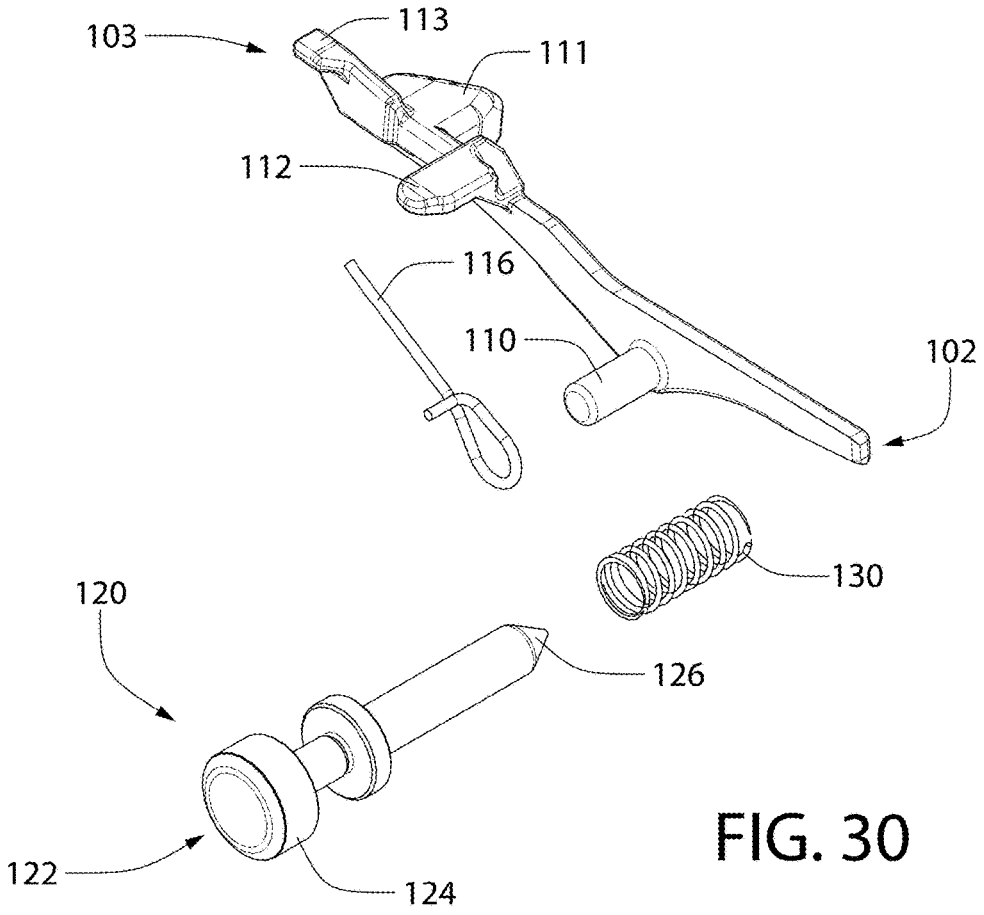
FIG. 30 is a third exploded perspective view thereof.

In one embodiment shown in FIGS. 8-9 and 13, locking ledge 114 may be formed on the underside of one of the lateral sides 58 of the bolt body. In the present embodiment, locking ledge 114 is formed on the bottom of the left lateral side of bolt 50. Locking ledge 114 defines a forward facing locking surface 114-1 which engages the bolt catch protrusion 113 when the bolt catch lever 101 is actuated and in its upward engaged position. Locking surface 114-1 may be formed at the rear end of a downwardly open longitudinal recess 114-2 formed forward of the locking surface on the bolt. In one embodiment, longitudinal recess 114-2 may be formed on the underside of the left lateral side of the bolt 50 and slideably receives the bolt catch protrusion 113 when the bolt catch protrusion is moved upwards with the rear end of the bolt catch lever as it pivots to its upward engaged position and the bolt is attempting to be returned forward by the recoil spring from the bolt's rear open breech position. Bolt catch protrusion 113 slides rearward in the recess until it meets and engages the locking ledge 114 and locking surface 114-1, which thereby retains the bolt in the rearward open breech position.

In one embodiment, the locking ledge 114 and longitudinal recess 114-2 may be formed on the rear bolt piece 50-2 for the two-piece bolt 50 construction. The locking ledge is positioned on the bolt relative to the bolt catch protrusion 113 of the bolt catch lever 101 to establish and retain the open breech until the bolt is manually released forward by the user via actuating handle 111 or actuator plunger 120.

Actuating handle 111 protrudes laterally/transversely outwards from exterior side 104 of the bolt catch lever 101 from the rear portion 103-1 of the lever defined between pivot pin 110 and rear end 103. The actuating handle may be disposed proximate to rear end 103 of the bolt catch lever 101, and in one embodiment may define the rear end. Actuating handle 111 may be disposed adjacent to and on the opposite side of the bolt catch protrusion 113 on the lever to maximize leverage about the pivot axis PA and range of vertical motion of the bolt catch protrusion to positively engage the bolt when actuated. The actuating handle may have any suitable configuration to enhance grasping by the user to manually actuate the bolt catch lever 101 for either engaging and locking the bolt 50 in its rearward open breech position, or disengaging and releasing the bolt forward. Handle 111 is pushed upward to engage the bolt, and pushed downwards by the user to disengage the bolt.

Follower engagement protrusion 112 of bolt catch lever 101, which is configured and arranged to be automatically engaged by follower 33-1 of the magazine 33 when empty, protrudes perpendicularly and laterally/transversely inwards in a horizontal direction from interior side 104 of the bolt catch lever 101. Follower engagement protrusion 112 may be disposed on the rear portion 103-1 of the lever defined between pivot pin 110 and rear end 103. The follower engagement protrusion may be located forward of actuating handle 111 on bolt catch lever 101 in one embodiment. Follower engagement protrusion 112 may have a transversely elongated and can have a generally flattened body in one embodiment.

With additional reference to FIGS. 14-23 as applicable, follower engagement protrusion 112 extends inwards into a central opening 115 of fire control insert 23-1 which is located directly above and communicates with magazine well 32 of the pistol grip frame 82-1. The follower engagement protrusion may be located proximate to the front of central opening 115 and magazine well 32 for engagement by the magazine follower 33-1 after the last cartridges has been dispensed from the magazine. The follower engagement protrusion therefore extends inwards into the central opening 115 by a sufficient distance to positively engage the magazine follower 33-1 when no rounds remain in the magazine.

After the last chambered round (cartridge) is fired from the magazine 33, the magazine follower 33-1 forced upwards by magazine spring 33-2 will protrude up into the breech area of receiver 21 from the top of the magazine to engage and force the follower engagement protrusion 112 of bolt catch lever 101 upwards. This pivots the rear end 103 of the bolt catch lever in turn about its pivot axis PA (defined by pivot pin 110) which moves from the downward disengaged position to the upward engaged position. This motion in turn raises the bolt catch protrusion 113 upward to engage the locking ledge 114 of the bolt as it attempts to return forward under the biasing action of recoil spring 54. The breech is therefore locked in the open position via automatic operation of the magazine follower 33-1 and follower engagement protrusion 112. To release the bolt, the user manually depresses actuating handle 111 downward as previously described herein, or alternatively uses actuator plunger 120.

Catch spring 116 is configured and operable to bias bolt catch lever 101 towards it downward disengaged position to prevent interference with cycling of bolt 50 rearward and forward under normal operation of the firearm when firing until the bolt catch lever is activated. The catch spring 116 may be a torsion spring in one embodiment which is mounted about pivot pin 110. Spring 116 may comprise a rear partial coil section 116-1 which engages and partially wraps around the pivot pin and a forward extending leg 116-2 which acts downward on magazine-operated follower engagement protrusion 112 to bias the bolt catch lever downwards (see, e.g., FIG. 28). Other types of springs and arrangements may be used to provide the desired biasing operation.

Actuator plunger 120 provides manual ambidextrous operation of the bolt-catch release mechanism from the opposite side of the firearm on which the bolt catch lever 101 is disposed. Specially, the actuator plunger when depressed is therefore configured and operable to engage and actuate the bolt catch lever, thereby causing the lever to disengage and release the bolt 50 when locked rearward by the bolt catch without use of the actuating handle 111 on the bolt catch lever.

Referring generally to FIGS. 24-33, the manually depressible spring-biased actuator plunger 120 may be transversely mounted in the firearm relative to the longitudinal axis LA (e.g., perpendicularly) and extends through the firearm from one lateral side 21-1 (e.g., right side) to the opposite lateral side 21-2. In one embodiment, plunger 120 may be transversely mounted to and slideably received through a laterally open transverse mounting passage 121 formed through the front portion of fire control insert 23-1 from side to side (see also FIGS. 14-23).

Figure 32:
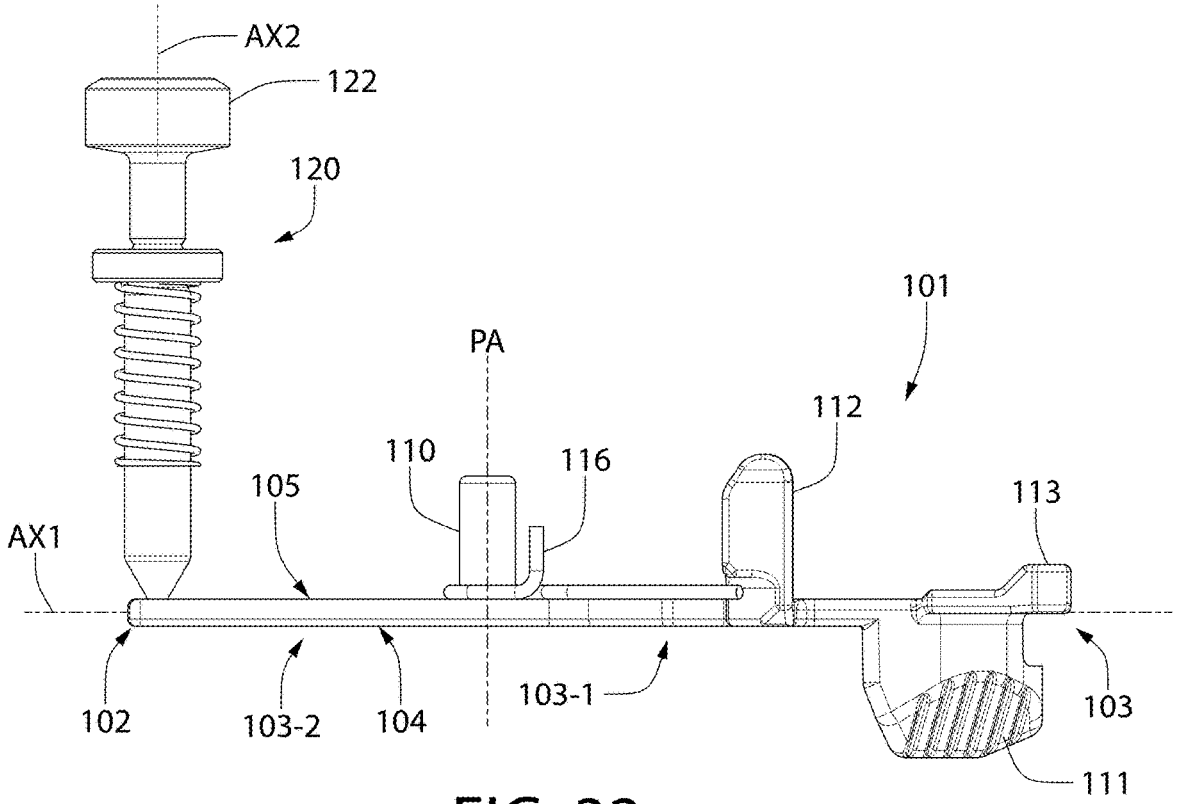
FIG. 32 is a top view thereof in an assembled condition.
Figure 33:
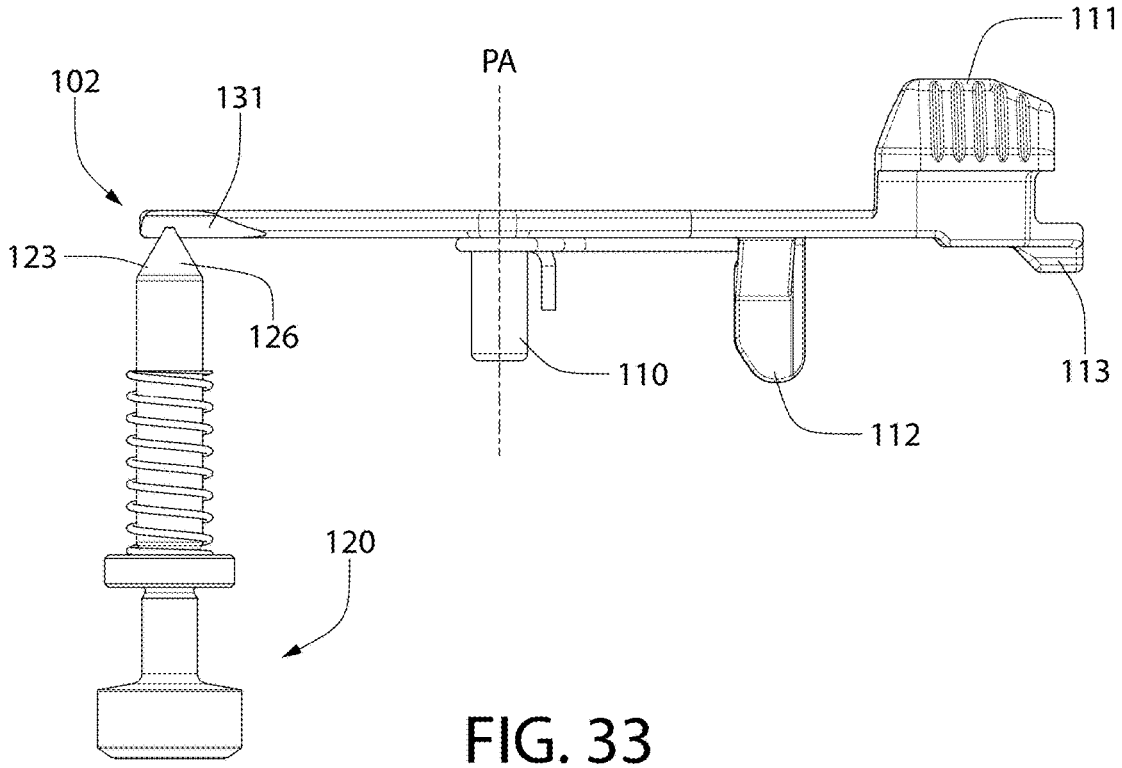
FIG. 33 is a bottom view thereof.
Figure 34:
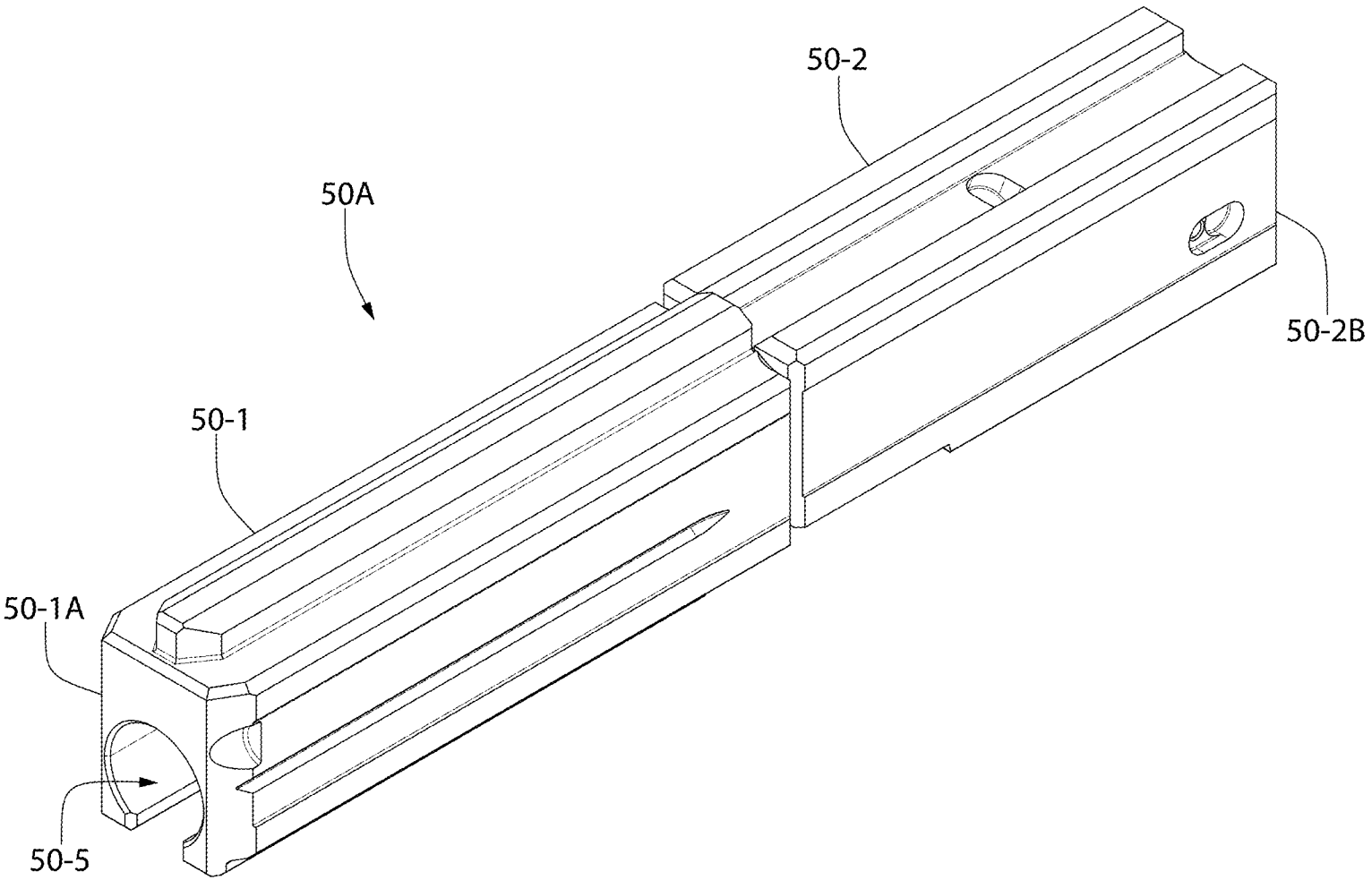
FIG. 34 is first front perspective view of an alternative embodiment of a bolt assembly for the firearm.
Figure 35:
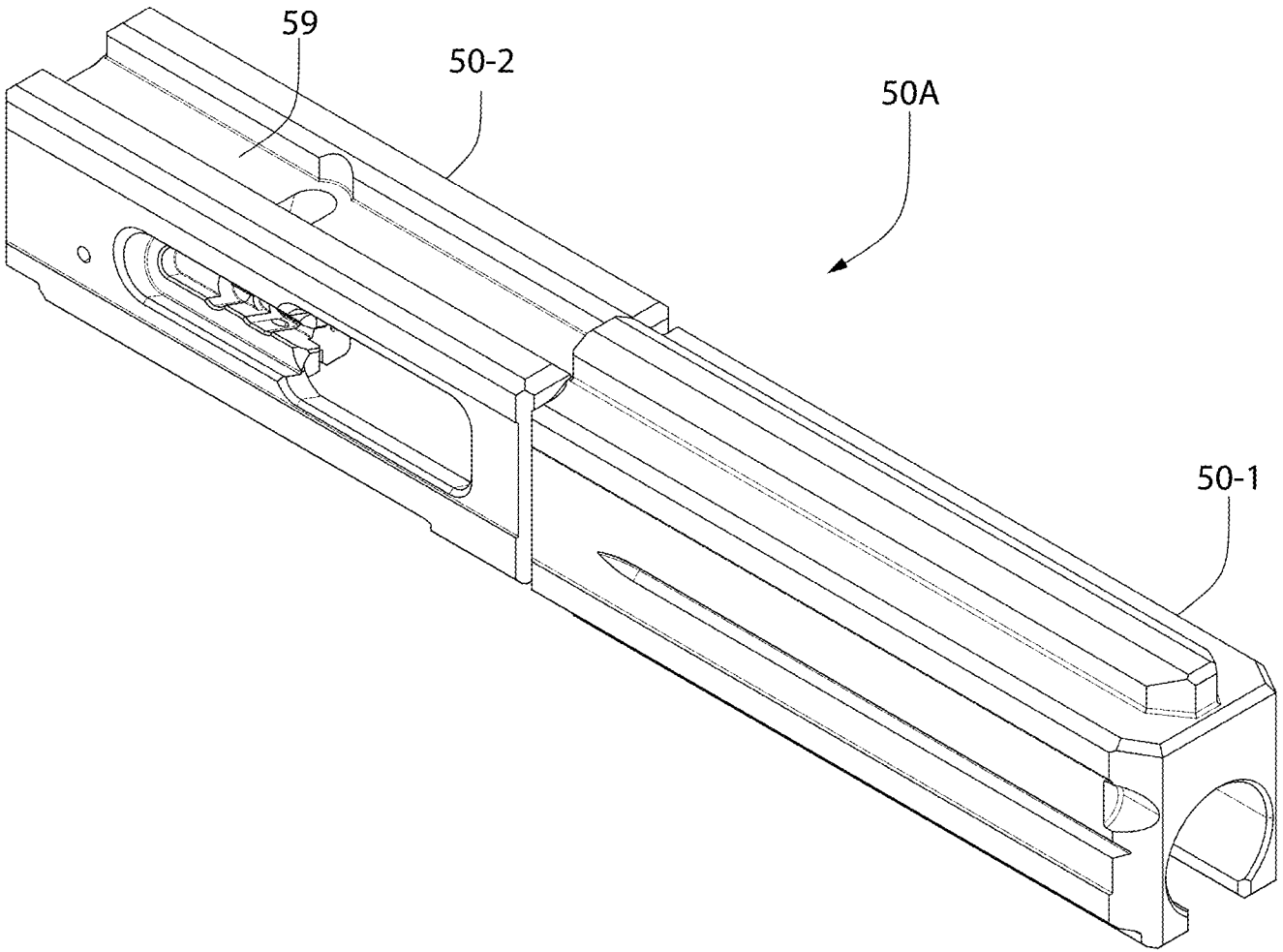
FIG. 35 is a second front perspective view thereof.
Figure 36:
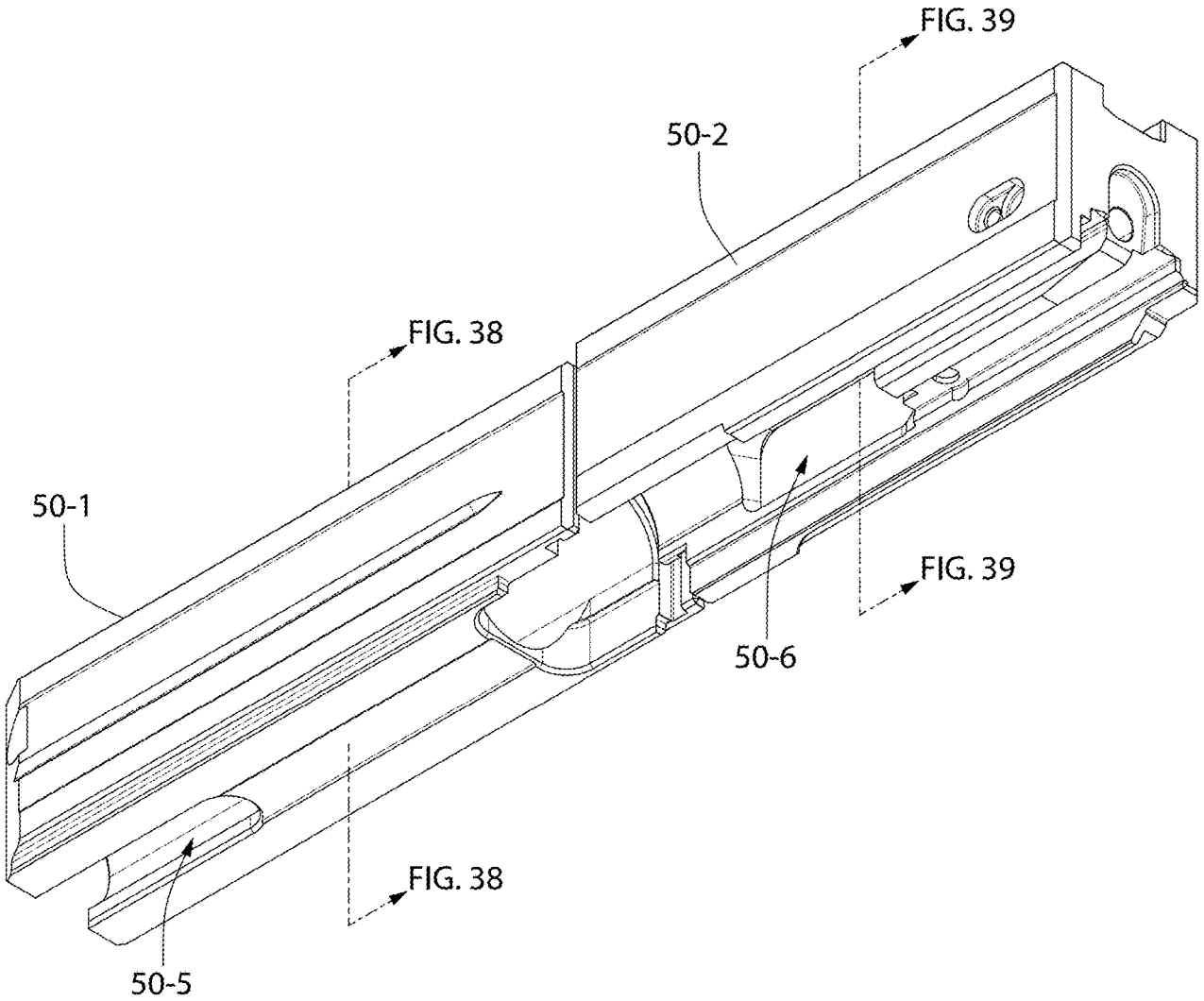
FIG. 36 is a first bottom rear perspective view thereof.
Figure 37:
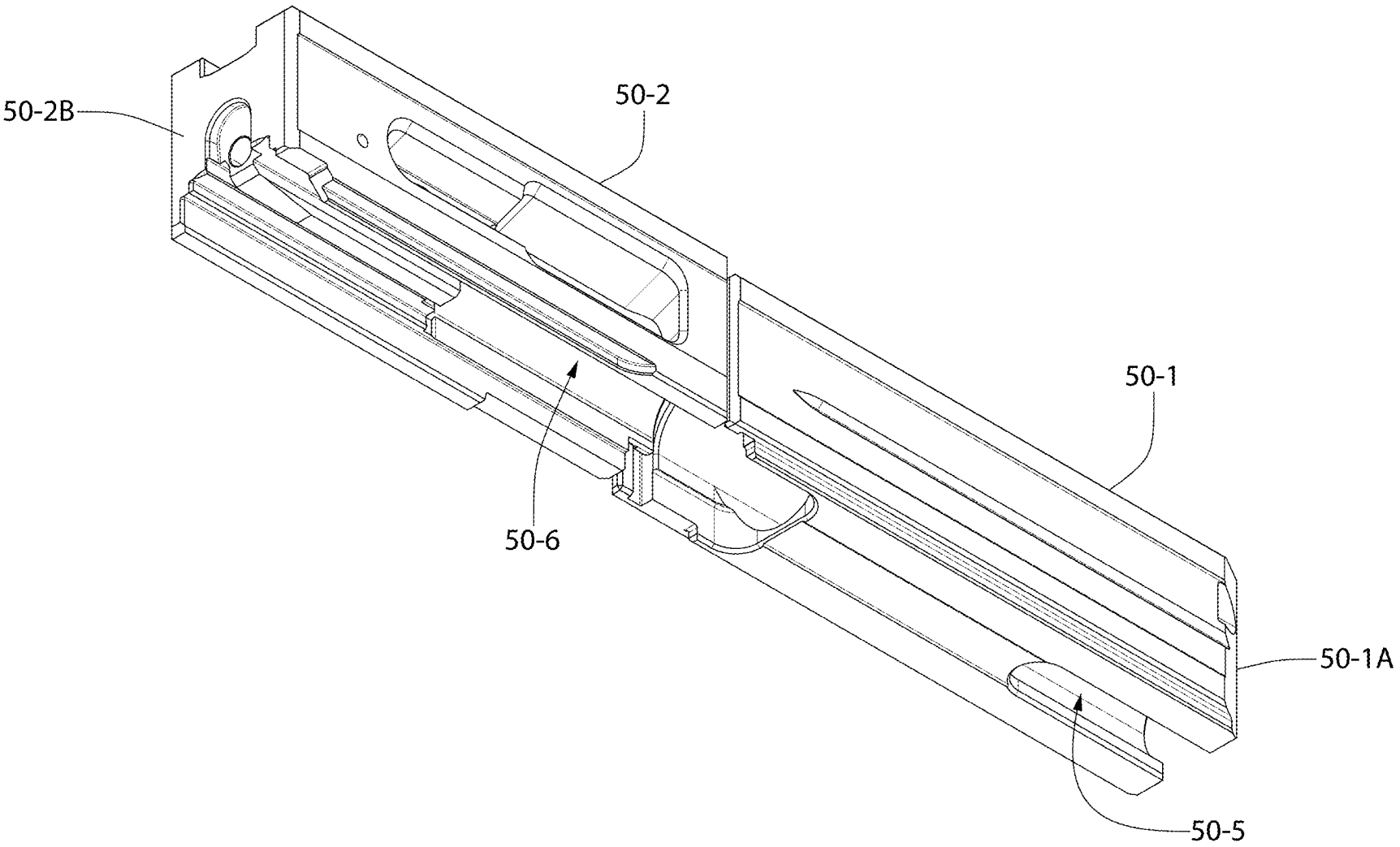
FIG. 37 is a second bottom rear perspective view thereof.

As shown in FIG. 32, actuator plunger 120 is oriented perpendicularly to the bolt catch lever 101. The elongated body of bolt catch lever 101 defines a lever axis AX1 and plunger 120 defines a plunger axis AX2 which is oriented perpendicularly to the lever axis. Plunger 120 operably interacts with the front portion 103-2 of bolt catch lever 101, and in a preferred but non-limiting embodiment shown engages the lever proximate to the front end 102 thereof, as further described herein.

Actuator plunger 120 is slideably moveable transverse to the longitudinal axis LA of the firearm between (1) an actuated position engaged with the bolt catch lever 101 (see, e.g., FIG. 11), and (2) an unactuated position (see, e.g., FIG. 10) disengaged from the bolt catch lever to avoid interference with operation of the lever when actuated manually via actuating handle 111 or magazine-operated follower engagement protrusion 112. In the "engaged" position, the plunger 120 actively displace and pivots the bolt catch lever 101 about its pivot axis PA to activate the bolt stop function. In the "disengaged" position, the plunger does not engage altogether or does not sufficiently engage the bolt catch lever to the degree necessary to impart motion to and actuation of the bolt catch lever to release the bolt (although some minor contact between these parts may exist). The actuator plunger 120 converts sliding linear motion of the plunger into rotational/pivoting motion of the bolt catch lever 101 about its pivot axis PA.

In one embodiment, actuator plunger 120 comprises a generally cylindrical body 120-1 comprising an externally exposed operating end 122 configured for operating the plunger by the user, and an opposite working end 123 configured to selectively engage and rotate the bolt catch lever when the plunger is actuated. Operating end 122 may be diametrically enlarged in one embodiment defining an enlarged circular head 124 which protrudes outwards to facilitate ease of operation by the user for depressing the plunger towards the bolt catch lever 101. In other embodiments, the operating end may not be diametrically enlarged.

Plunger spring 130 biases the plunger 120 towards the unactuated position "operably" disengaged from the bolt catch lever 101 as explained above. Spring 130 may be a helical compression spring in one embodiment which is disposed inside the transverse mounting passage 121 of fire control insert 23-1 and coiled around the plunger body (see, e.g., FIGS. 10-11). In one embodiment, plunger 120 includes diametrically enlarged travel stop flange 125 which is selectively engageable with a pair of opposing travel stop surfaces 131 and 132 formed inside mounting passage 121. The flange 125 may be slideably disposed inside a corresponding diametrically enlarged chamber 133 of the mounting passage which defines stop surfaces 131, 132 at opposite sides thereof as shown. Travel stop flange 125 abuttingly engages travel stop surface 131 when the plunger is not actuated (i.e. depressed inwards by the user). When the user depresses plunger 120, the stop flange engages the opposite travel stop surface 132. The travel stop flange and stop surfaces limit the lateral/transverse range of motion of the plunger 120.

The working end 123 of actuator plunger 120 is configured to operably interact with and impart motion to the bolt catch lever 101 to disengage and release bolt in the manner previously described herein when the plunger is depressed inwards by the user towards the lever. In one embodiment, the user applies a non-rotating inward linear force F as shown in FIG. 11 to the operating end 122 (e.g., enlarged circular head 124) of the plunger. This slides the plunger transversely and perpendicularly towards bolt catch lever 101. Mutually engaged sliding surfaces of the plunger and bolt catch lever respectively operably cooperate to actuate and rotate the bolt catch lever. It bears noting that there is no abutting engagement between the plunger and bolt catch lever when the plunger is depressed and actuated which would force the lever laterally outwards from the firearm. Instead, a lifting motion is applied to the front end 102 of bolt catch lever 101 by the actuator plunger 120 via a pair of mating inclined surfaces 126, 131 which slide relative to each other, as described below.

With continuing reference to FIGS. 24-33 and also FIGS. 10-11, working end 123 of actuator plunger 120 includes an inclined camming surface 126 which slideably engages a corresponding inclined camming ramp 131 formed on the bolt catch lever 101 to pivot the bolt catch lever from the engaged position to the disengaged position when the actuator plunger is depressed and actuated. In one embodiment, the plunger working end 123 may have a configuration forming a conically shaped tip which defines a circumferential continuum of inclined camming surfaces 126 on the working end having the same angle of inclination or slope. With this conical tip design, any slight rotation of the cylindrical-bodied plunger about its plunger axis AX2 which might possibly occur when the user pushes the plunger inwards will advantageously ensure that inclined camming surface 126 is always properly oriented with respect to the inclined camming ramp 131 on bolt catch lever 101 to ensure reliable operation of the bolt-catch release mechanism. This design also obviates any need for anti-rotation features to be incorporated into the plunger mechanism to ensure proper alignment and orientation of the plunger camming surface 126 with the bolt catch lever camming ramp 131.

In other possible embodiments contemplated, however, actuator plunger 120 may have a non-cylindrically shaped body and/or may include anti-rotation features if provided with a single inclined camming surface on the plunger working end 123 of fixed orientation rather than a conical tip.

It bears noting that in yet other possible embodiments, only one inclined surface such as camming surface 126 on plunger 120 or the camming ramp 131 bolt catch lever 102.

The inclined camming ramp 131 on bolt catch lever 101 may be disposed on a front portion 103-2 of the bolt catch lever forward of the pivot axis PA. In one embodiment, camming ramp 131 may be formed on the underside/bottom of the front end 102 of the bolt catch lever near the tip. This advantageously maximizes the length of the lever arm between the camming ramp and pivot axis PA in the middle section of the lever (formed by pivot pin 110 which acts as a fulcrum) so that raising the front end of the bolt catch lever via operation of actuator plunger 120 concomitantly lowers the bolt catch protrusion 113 formed on rear end 103 of the lever with sufficient force to ensure positive disengagement with and release of the spring-biased bolt 50 forward.

Figure 31:
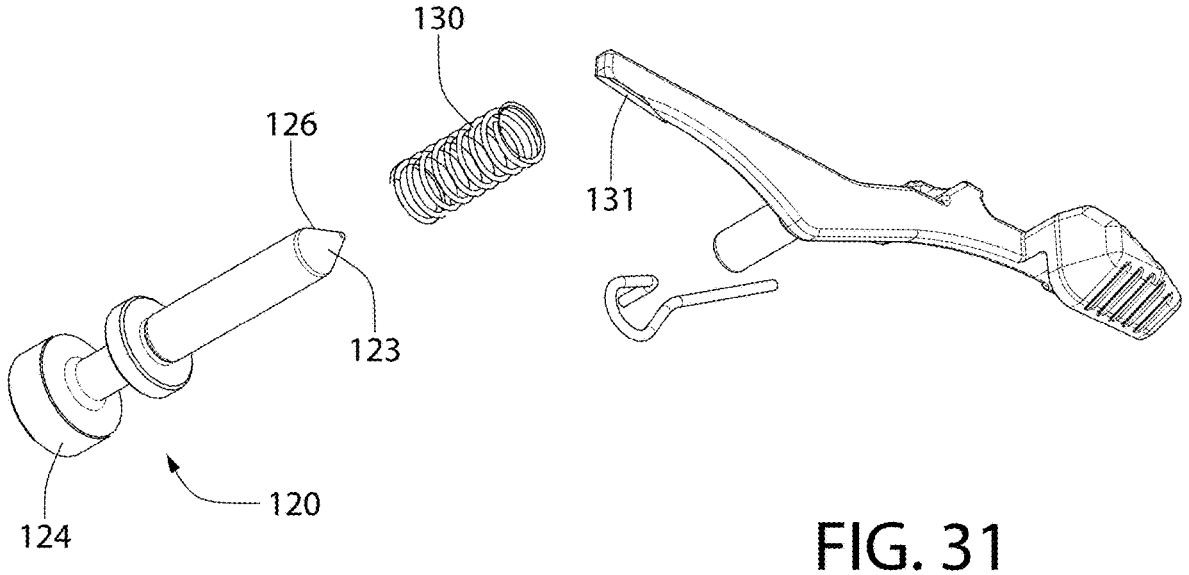
FIG. 31 is a fourth exploded perspective view thereof.

In one embodiment, with reference to FIGS. 10-11 and 31, the inclined camming ramp 131 of bolt catch lever 101 may slope in the lateral direction of the plunger axis AX1 and a transverse to both vertical reference plane VP of the bolt catch lever and longitudinal axis LA of the firearm. The low point on the ramp is therefore toward and adjacent the exterior side 104 of bolt catch lever 101, while the high point is adjacent the interior side 105 of the bolt catch lever. Inclined camming surface 126 of the plunger 120 is sloped in a similar direction and orientation with the low point on the surface being adjacent to the end of the pointed conical tip of the working end 123 of the plunger. The inclined camming surface 126 and ramp 131 have complementary angles of inclination so that a flat-to-flat sliding interface is formed therebetween in operation of the plunger to raise the front end 102 of bolt catch lever 101 and rotate the rear end 103 of the lever downwards about pivot pin 110. Accordingly, actuator plunger is operable to slideably engage the bolt catch lever when the user actuates the plunger.

In other possible alternative embodiments, the inclined camming ramp 131 of bolt catch lever 101 may alternatively be sloped in the axial/longitudinal direction on the underside of the lever front end 102 (i.e. front to rear of the lever) to engage the camming surface 126 formed on the pointed conical tip of the plunger working end 123. Wedging action imparted to the bolt catch lever by actuator plunger 120 which operates to rotate the lever between its engaged and disengaged positions as previously described herein would function in the same way.

Bolt catch lever 101 and actuator plunger 120 preferably may each be formed of a suitable metallic material such as steel, aluminum, titanium, or other. Bolt catch lever 101 in one non-limiting embodiment may have a one-piece monolithic unitary structure in one embodiment wherein each of the foregoing operating features 110-113 previously described herein are formed as integral parts thereof. Plunger 120 may have a similar one-piece monolithic unitary structure.

A process or method for operating bolt catch 100 of a firearm 20 will now be briefly described with reference to the figures. The firearm may begin in a ready-to-fire position with a closed breech shown in FIG. 3. Bolt 50 is in battery with the rear breech end of the barrel 22 under the forward biasing action of recoil spring 54. The bolt catch lever 101 of the bolt catch in the normal downward and lower disengaged position from bolt 50 under the biasing action of catch spring 116. Accordingly, bolt catch protrusion 113 is not projected upward to engage the bolt which would might interfere with normal cycling of the action (e.g., bolt 50) forward and rearward when discharging the firearm.

Operation of the bolt catch 100 starts with first moving bolt 50 from the forward closed breech position in battery with the barrel to the rearward open breech position (see, e.g., FIG. 8A). This can be performed either manually by the user pulling rearward on charging handle 51 to retract the bolt, or automatically via discharging with firearm which automatically moves the bolt rearward under recoil or other means such as a gas system.

With the bolt in the rearward open breech position, the method continues with engaging the bolt catch lever 101 with the bolt 50 to hold the bolt rearward. Specially, this involves rotating bolt catch protrusion 113 on lever 101 upwards about the lever pivot axis PA in a first direction to engage locking ledge 114 on the bolt. This can performed manually by the user pushing actuating handle 111 upwards to engage bolt catch protrusion 113 with the bolt, or automatically via operation of the last round bolt "hold open" feature previously described herein (i.e. magazine follower 33-1 engaging and forcing the follower engagement protrusion 112 of bolt catch lever 101 upwards to engage the bolt catch protrusion with the bolt). Either operating scenario results in the bolt 50 being locked and held rearward with an open breech.

To release the bolt 50 from the side of the firearm opposite the bolt catch lever, the method continues with the user pushing and sliding the actuator plunger 120 in a laterally inwards transverse direction towards to the bolt catch lever 101 from an unactuated position to an actuated position. This results in slideably engaging inclined camming surface 126 on the actuator plunger 120 with an inclined camming ramp 131 on the bolt catch lever, thereby rotating the bolt catch lever about the pivot axis PA in a second direction which disengages and releases the bolt from the open breech position. Specifically, "wedging" action applied to the underside of the front end 102 of the bolt catch lever via mutual sliding engagement between the inclined camming surface and ramp raises the lever front end and correspondingly forces the opposite rear end 103 downwards about pivot axis PA to disengage the bolt catch protrusion 113 from locking ledge 114 on bolt 50, thereby returning the bolt forward to reclose the breech via the biasing action of recoil spring 54 previously described herein.

Although bolt catch lever 101 is illustrated and described herein as being located on the left side of the firearm (i.e. left lateral side 21-2 of receiver 21) and the operating end 122 (e.g., enlarged head 124) of actuator plunger 120 is on the right lateral side 21-1, these locations may be reversed in other embodiments provided the locking ledge 144 of bolt 50 is provided on the opposite side from that illustrated to allow the bolt catch to lock the bolt rearward. Accordingly, the invention is not limited to either arrangement which will function the same as described herein.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A modular bolt assembly system for a firearm with blowback operating system comprising:

a longitudinal axis;

a first front bolt piece having a first mass and internally comprising a first longitudinal passage coaxial with the longitudinal axis, the first longitudinal passage being configured to receive a rear portion of a first firearm barrel chambered for a first cartridge;

a second front bolt piece having a second mass different than the first mass, the second front bolt piece internally comprising a second longitudinal passage coaxial with the longitudinal axis, the second longitudinal passage being configured to receive a rear portion of a second firearm barrel chambered for a second cartridge having a propellant powder charge with energy different than the first cartridge;

a rear bolt piece internally comprising a third longitudinal passage coaxial with the longitudinal axis, the third longitudinal passage comprising a breech face and being configured to receive the rear portions of the first or second firearm barrel;

wherein the first and second front bolt pieces each have a common first coupling interface configured to mate with a corresponding complementary configured second coupling interface formed on the rear bolt piece;

wherein the rear bolt piece is detachably coupleable to the first or second front bolt piece to form a mechanical interlock which prevents separation thereof in a direction along the longitudinal axis.

2. The system according to claim 1, wherein the third longitudinal passage of the rear bolt piece is in communication with the first longitudinal passage or the second longitudinal passage depending on whether the first front bolt piece or the second front bolt piece is coupled to the rear bolt piece.

3. The system according to claim 1, wherein the first and second front bolt pieces each have a similar configuration.

4. The system according to claim 3, wherein the common first coupling interface of the first and second front bolt pieces comprises: (1) a male key which is insertable into a female keyway of the rear bolt piece; or (2) a female keyway which receives a male key of the rear bolt piece.

5. The system according to claim 4, wherein the male key comprises a U-shaped coupling protrusion and the female keyway comprises a complementary configured U-shaped coupling channel into which the coupling protrusion is slideably insertable.

6. The system according to claim 5, wherein the coupling protrusion is disposed on a front of the rear bolt piece and the coupling channel is disposed on a rear of the first and second front bolt pieces.

7. The system according to claim 2, wherein the first longitudinal passage extends completely through the first front bolt piece from end to end, and the second longitudinal passage extends completely through the second front bolt piece from end to end.

8. The system according to claim 1, wherein the rear bolt piece includes a firing pin.

9. The system according to claim 1, wherein the bolt assembly is configured so as to be non-rotatable in the receiver.

10. The system according to claim 6, wherein the coupling protrusion comprises a radially projecting flange which is integrally formed with the rear bolt piece as a unitary structural part thereof and insertable into the coupling channel of the rear bolt piece.

11. The system according to claim 1, further comprising a helical recoil spring mounted on a guide rod which is slideably receivable inside an axial guide rod passage formed in each of the first and second front bolt pieces.

12. The system according to claim 11, wherein the guide rod is projectible forward and rearward in the guide rod passage when the bolt assembly moves along the longitudinal axis between a rearward open breech position and a forward closed breech position when mounted in an axially elongated internal cavity of a receiver of the firearm.

13. The system according to claim 12, wherein the guide rod is fixedly attached to the receiver and remains stationary when the bolt assembly moves between the open breech position and the closed breech position.

14. The system according to claim 13, wherein the recoil spring acts on a rear end of the first or second front bolt piece when coupled to the bolt piece alone at a rear entrance to the guide rod passage to bias the entire bolt assembly forward to the forward closed breech position.

15. The system according to claim 1, wherein each of the first and second front bolt pieces and the rear bolt piece comprise a pair of linear bottom longitudinal support surfaces configured to slideably engage a bottom surface in an internal cavity of a receiver when the bolt assembly is mounted in the firearm.

16. The system according to claim 1, wherein each of the first and second front bolt pieces and the rear bolt piece has a substantially rectangular cuboid configuration.

17. The system according to claim 4, wherein the male key is insertable into the female keyway in a direction transverse to the longitudinal axis of the bolt assembly.

18. The system according to claim 1, wherein the first, second, and third longitudinal passages of the first front bolt piece, second front bolt piece, and rear bolt piece are formed internally in the first front bolt piece, second front bolt piece, and rear bolt piece, respectively.

19. The system according to claim 1, wherein the third longitudinal passage of the rear bolt piece extends partially rearward from a front end of the rear bolt piece to a point terminated by a vertical breech face inside the third longitudinal passage.

20. The system according to claim 19, wherein the breech face is configured to engage a rear breech end of a barrel of a firearm defining a chamber for an ammunition cartridge.

* * * * *